US011217180B2

(12) United States Patent
Hong

(10) Patent No.: US 11,217,180 B2
(45) Date of Patent: Jan. 4, 2022

(54) DISPLAY DEVICE, AND METHOD OF DETERMINING A POWER SUPPLY VOLTAGE BASED ON GRAY LEVEL AND VOLTAGE DROP

(71) Applicant: Samsung Display Co., Ltd., Yongin-si (KR)

(72) Inventor: Seok Ha Hong, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/999,779

(22) Filed: Aug. 21, 2020

(65) Prior Publication Data

US 2021/0166634 A1 Jun. 3, 2021

(30) Foreign Application Priority Data

Dec. 3, 2019 (KR) ..... 10-2019-0158938

(51) Int. Cl.
*G09G 3/3275* (2016.01)

(52) U.S. Cl.
CPC ..... *G09G 3/3275* (2013.01); *G09G 2310/027* (2013.01); *G09G 2330/021* (2013.01)

(58) Field of Classification Search
CPC ..... G09G 3/3275
USPC ..... 345/211
See application file for complete search history.

(56) References Cited

U.S. PATENT DOCUMENTS

2010/0149167 A1* 6/2010 Hasegawa ..... G09G 3/3225 345/213
2012/0249514 A1* 10/2012 Ahn ..... G09G 3/3233 345/212
2019/0051234 A1* 2/2019 Ishii ..... G09G 3/3208

FOREIGN PATENT DOCUMENTS

KR 10-0993059 11/2010

* cited by examiner

*Primary Examiner* — Long D Pham
(74) *Attorney, Agent, or Firm* — Lewis Roca Rothgerber Christie LLP

(57) ABSTRACT

A display device includes: a display panel including a plurality of pixels; a power supply configured to provide a power supply voltage to the display panel; and a controller configured to control the power supply, the controller including: a motion calculation block configured to calculate a motion amount of image data based on the image data in a previous frame and the image data in a current frame, and to determine a motion gain based on the motion amount of the image data; a maximum gray determination block configured to determine a maximum gray level of the image data in the current frame; a voltage drop calculation block configured to calculate a voltage drop amount in the display panel; and a power supply voltage determination block configured to determine an initial voltage level of the power supply voltage.

20 Claims, 16 Drawing Sheets

192a

| GRAY LEVEL | ELVDD_VL |
|---|---|
| 0G | EVDVL0 |
| 1G | EVDVL1 |
| ⋮ | ⋮ |
| 254G | EVDVL254 |
| 255G | EVDVL255 |

DISPLAY DEVICE, AND METHOD OF DETERMINING A POWER SUPPLY VOLTAGE BASED ON GRAY LEVEL AND VOLTAGE DROP

CROSS-REFERENCE TO RELATED APPLICATION

The present application claims priority to and the benefit of Korean Patent Application No. 10-2019-0158938, filed on Dec. 3, 2019 in the Korean Intellectual Property Office (KIPO), the entire disclosure of which is incorporated herein by reference in its entirety.

BACKGROUND

1. Field

Aspects of some example embodiments relate to a display device.

2. Description of the Related Art

In a display device, such as an organic light emitting diode (OLED) display device, a power supply voltage (e.g., ELVDD) provided to a display panel may be determined or set to be sufficiently high in consideration of a drain-source voltage of a driving transistor of each pixel, a voltage applied to an organic light emitting diode and a voltage drop (e.g., an IR drop) margin of the power supply voltage. However, if the power supply voltage is set to be excessively high, power consumption of the display device may be excessively increased.

The above information disclosed in this Background section is only for enhancement of understanding of the background and therefore the information discussed in this Background section does not necessarily constitute prior art.

SUMMARY

Aspects of some example embodiments relate to a display device, and for example, to a display device configured to adjust a power supply voltage provided to a display panel, and a method of determining the power supply voltage.

Aspects of some example embodiments include a display device that may be capable of reducing power consumption based on a motion amount of image data.

Aspects of some example embodiments include a method of determining a power supply voltage capable of reducing power consumption based on a motion amount of image data.

According to some example embodiments, a display device includes a display panel including a plurality of pixels, a power supply configured to provide a power supply voltage to the display panel, and a controller configured to control the power supply. The controller includes a motion calculation block configured to calculate a motion amount of image data based on the image data in a previous frame and the image data in a current frame, and to determine a motion gain based on the motion amount of the image data, a maximum gray determination block configured to determine a maximum gray level of the image data in the current frame, a voltage drop calculation block configured to calculate a voltage drop amount in the display panel based on the image data in the current frame and resistor information for a wiring of the power supply voltage, and a power supply voltage determination block configured to determine an initial voltage level of the power supply voltage based on the maximum gray level and the voltage drop amount, and to determine a final voltage level of the power supply voltage by applying the motion gain to the initial voltage level.

According to some example embodiments, the motion calculation block may be configured to calculate, as the motion amount of the image data, a difference between the image data in the previous frame and the image data in the current frame, and to determine the motion gain such that the motion gain decreases as the motion amount of the image data increases.

According to some example embodiments, the image data for the display panel may be divided into a plurality of block image data for a plurality of pixel blocks. The motion calculation block may include a block sum storage configured to store previous block sum values of the plurality of block image data in the previous frame, a block sum calculator configured to calculate current block sum values of the plurality of block image data in the current frame, a motion amount calculator configured to calculate, as block motion amounts of the plurality of block image data, differences between the previous block sum values and the current block sum values, and to calculate the motion amount of the image data by summing the block motion amounts of the plurality of block image data, and a motion gain determiner configured to determine the motion gain based on the motion amount of the image data.

According to some example embodiments, the motion gain determiner may be configured to compare the motion amount with a first reference motion amount and a second reference motion amount greater than the first reference motion amount, determine the motion gain as a high motion gain level when the motion amount is less than the first reference motion amount, determine the motion gain as a low motion gain level when the motion amount is greater than or equal to the second reference motion amount, and determine the motion gain such that the motion gain gradually decreases from the high motion gain level to the low motion gain level as the motion amount increases from the first reference motion amount to the second reference motion amount when the motion amount is greater than or equal to the first reference motion amount and less than the second reference motion amount.

According to some example embodiments, the maximum gray determination block may be configured to divide the image data for the display panel into a plurality of block image data for a plurality of pixel blocks, and to determine a plurality of block maximum gray levels of the plurality of block image data.

According to some example embodiments, the voltage drop calculation block may be configured to convert the image data for the display panel into a current value, and to calculate the voltage drop amount by multiplying the current value and a resistance value represented by the resistor information.

According to some example embodiments, the display panel may be divided into a plurality of pixel blocks. The voltage drop calculation block may include a block current map generator configured to generate a block current map representing a plurality of block current values for the plurality of pixel blocks based on the image data, a resistor information storage configured to store the resistor information representing a plurality of resistance values for the wiring of the power supply voltage between the plurality of pixel blocks, and a block voltage drop calculator configured to calculate a plurality of block voltage drop amounts in the plurality of pixel blocks based on the plurality of block current values represented by the block current map and the plurality of resistance values represented by the resistor information.

According to some example embodiments, the block current map generator may include a gray-current lookup table configured to store current values respectively corresponding to a plurality of gray levels, a pixel current determiner configured to convert a plurality of pixel image data included in the image data into a plurality of pixel current values by using the gray-current lookup table, and a block current summer configured to calculate the plurality of block current values by summing the plurality of pixel current values with respect to each of the plurality of pixel blocks, and to generate the block current map representing the plurality of block current values.

According to some example embodiments, the power supply voltage determination block may be configured to determine a first voltage level corresponding to the maximum gray level, to determine the initial voltage level by adding the voltage drop amount to the first voltage level, and to determine the final voltage level by multiplying the initial voltage level by the motion gain.

According to some example embodiments, the power supply voltage determination block may receive a plurality of block maximum gray levels as the maximum gray level from the maximum gray determination block, and may receive a plurality of block voltage drop amounts as the voltage drop amount from the voltage drop calculation block. The power supply voltage determination block may include a gray-voltage level lookup table configured to store voltage levels respectively corresponding to a plurality of gray levels, a block initial voltage determiner configured to determine a plurality of first block voltage levels respectively corresponding to the plurality of block maximum gray levels by using the gray-voltage level lookup table, and to determine a plurality of second block voltage levels by adding the plurality of block voltage drop amounts to the plurality of first block voltage levels, a multiplier configured to calculate a plurality of third block voltage levels by multiplying the plurality of second block voltage levels by the motion gain, and a final voltage determiner configured to determine a maximum one of the plurality of third block voltage levels as the final voltage level of the power supply voltage.

According to some example embodiments, the image data for the display panel may be divided into a plurality of block image data for a plurality of pixel blocks. The motion calculation block may include a block sum storage configured to store previous block sum values of the plurality of block image data in the previous frame, a block sum calculator configured to calculate current block sum values of the plurality of block image data in the current frame, a block motion amount calculator configured to calculate, as block motion amounts of the plurality of block image data, differences between the previous block sum values and the current block sum values, and a block motion gain determiner configured to determine, as the motion gain, a plurality of block motion gains based on the block motion amounts of the plurality of block image data.

According to some example embodiments, the block motion gain determiner may be configured to compare each of the block motion amounts with a first reference motion amount and a second reference motion amount greater than the first reference motion amount, determine each of the plurality of block motion gains as a high motion gain level when a corresponding one of the block motion amounts is less than the first reference motion amount, determine each of the plurality of block motion gains as a low motion gain level when the corresponding one of the block motion amounts is greater than or equal to the second reference motion amount, and determine each of the plurality of block motion gains such that each of the plurality of block motion gains gradually decreases from the high motion gain level to the low motion gain level as the corresponding one of the block motion amounts increases from the first reference motion amount to the second reference motion amount when the corresponding one of the block motion amounts is greater than or equal to the first reference motion amount and less than the second reference motion amount.

According to some example embodiments, the power supply voltage determination block may receive a plurality of block motion gains as the motion gain from the motion calculation block, may receive a plurality of block maximum gray levels as the maximum gray level from the maximum gray determination block, and may receive a plurality of block voltage drop amounts as the voltage drop amount from the voltage drop calculation block. The power supply voltage determination block may include a gray-voltage level lookup table configured to store voltage levels respectively corresponding to a plurality of gray levels, a block initial voltage determiner configured to determine a plurality of first block voltage levels respectively corresponding to the plurality of block maximum gray levels by using the gray-voltage level lookup table, and to determine a plurality of second block voltage levels by adding the plurality of block voltage drop amounts to the plurality of first block voltage levels, a plurality of multipliers configured to calculate a plurality of third block voltage levels by multiplying the plurality of second block voltage levels by the plurality of block motion gains, respectively, and a final voltage determiner configured to determine a maximum one of the plurality of third block voltage levels as the final voltage level of the power supply voltage.

According to some example embodiments, there is provided a method of determining a power supply voltage provided to a display panel. In the method, a motion amount of image data is calculated based on the image data in a previous frame and the image data in a current frame, a motion gain is determined based on the motion amount of the image data, a maximum gray level of the image data in the current frame is determined, a voltage drop amount in the display panel is calculated based on the image data in the current frame and resistor information for a wiring of the power supply voltage, an initial voltage level of the power supply voltage is determined based on the maximum gray level and the voltage drop amount, and a final voltage level of the power supply voltage is determined by applying the motion gain to the initial voltage level.

According to some example embodiments, the image data for the display panel may be divided into a plurality of block image data for a plurality of pixel blocks. To calculate the motion amount of the image data, previous block sum values of the plurality of block image data in the previous frame may be stored, current block sum values of the plurality of block image data in the current frame may be calculated, differences between the previous block sum values and the current block sum values may be calculated as block motion amounts of the plurality of block image data, and the motion amount of the image data may be calculated by summing the block motion amounts of the plurality of block image data.

According to some example embodiments, to determine the motion gain based on the motion amount of the image data, the motion amount may be compared with a first reference motion amount and a second reference motion amount greater than the first reference motion amount, the motion gain may be determined as a high motion gain level when the motion amount is less than the first reference motion amount, the motion gain may be determined as a low motion gain level when the motion amount is greater than or equal to the second reference motion amount, and the motion gain may be determined such that the motion gain gradually decreases from the high motion gain level to the low motion gain level as the motion amount increases from the first reference motion amount to the second reference motion amount when the motion amount is greater than or equal to the first reference motion amount and less than the second reference motion amount.

According to some example embodiments, to calculate the voltage drop amount in the display panel, the resistor information representing a plurality of resistance values for the wiring of the power supply voltage between a plurality of pixel blocks may be stored, a plurality of pixel image data included in the image data may be converted into a plurality of pixel current values by using a gray-current lookup table that stores current values respectively corresponding to a plurality of gray levels, a block current map representing a plurality of block current values may be generated by calculating the plurality of block current values by summing the plurality of pixel current values with respect to each of the plurality of pixel blocks, and a plurality of block voltage drop amounts in the plurality of pixel blocks may be calculated based on the plurality of block current values represented by the block current map and the plurality of resistance values represented by the resistor information.

According to some example embodiments, the maximum gray level may include a plurality of block maximum gray levels, and the voltage drop amount may include a plurality of block voltage drop amounts. To determine the initial voltage level of the power supply voltage based on the maximum gray level and the voltage drop amount, a plurality of first block voltage levels respectively corresponding to the plurality of block maximum gray levels may be determined by using a gray-voltage level lookup table that stores voltage levels respectively corresponding to a plurality of gray levels, and a plurality of second block voltage levels may be determined as the initial voltage level by adding the plurality of block voltage drop amounts to the plurality of first block voltage levels. To determine the final voltage level of the power supply voltage by applying the motion gain to the initial voltage level, a plurality of third block voltage levels may be calculated by multiplying the plurality of second block voltage levels by the motion gain, and a maximum one of the plurality of third block voltage levels may be determined as the final voltage level of the power supply voltage.

According to some example embodiments, the image data for the display panel may be divided into a plurality of block image data for a plurality of pixel blocks. To calculate the motion amount of the image data, previous block sum values of the plurality of block image data in the previous frame may be stored, current block sum values of the plurality of block image data in the current frame may be calculated, and block motion amounts of the plurality of block image data may be calculated as the motion amount by calculating differences between the previous block sum values and the current block sum values. To determine the motion gain based on the motion amount of the image data, a plurality of block motion gains may be determined as the motion gain based on the block motion amounts of the plurality of block image data.

According to some example embodiments, the maximum gray level may include a plurality of block maximum gray levels, and the voltage drop amount may include a plurality of block voltage drop amounts. To determine the initial voltage level of the power supply voltage based on the maximum gray level and the voltage drop amount, a plurality of first block voltage levels respectively corresponding to the plurality of block maximum gray levels may be determined by using a gray-voltage level lookup table that stores voltage levels respectively corresponding to a plurality of gray levels, and a plurality of second block voltage levels may be determined as the initial voltage level by adding the plurality of block voltage drop amounts to the plurality of first block voltage levels. To determine the final voltage level of the power supply voltage by applying the motion gain to the initial voltage level, a plurality of third block voltage levels may be calculated by multiplying the plurality of second block voltage levels by the plurality of block motion gains, respectively, and a maximum one of the plurality of third block voltage levels may be determined as the final voltage level of the power supply voltage.

As described above, a display device and a method of determining a power supply voltage according to some example embodiments may be configured to calculate a motion amount based on image data in a previous frame and the image data in a current frame, determine a motion gain based on the motion amount, determine a maximum gray level of the image data, calculate a voltage drop amount based on the image data and resistor information, determine an initial voltage level of the power supply voltage based on the maximum gray level and the voltage drop amount, and/or determine a final voltage level of the power supply voltage by applying the motion gain to the initial voltage level. Accordingly, in the display device and the method of determining the power supply voltage according to some example embodiments, because the power supply voltage may be adjusted based on the motion amount, power consumption of the display device may be reduced while maintaining a perceived display quality.

BRIEF DESCRIPTION OF THE DRAWINGS

Illustrative, non-limiting example embodiments will be more clearly understood from the following detailed description in conjunction with the accompanying drawings.

DETAILED DESCRIPTION

Hereinafter, aspects of some example embodiments of the present inventive concept will be explained in more detail with reference to the accompanying drawings.

Figure 1:
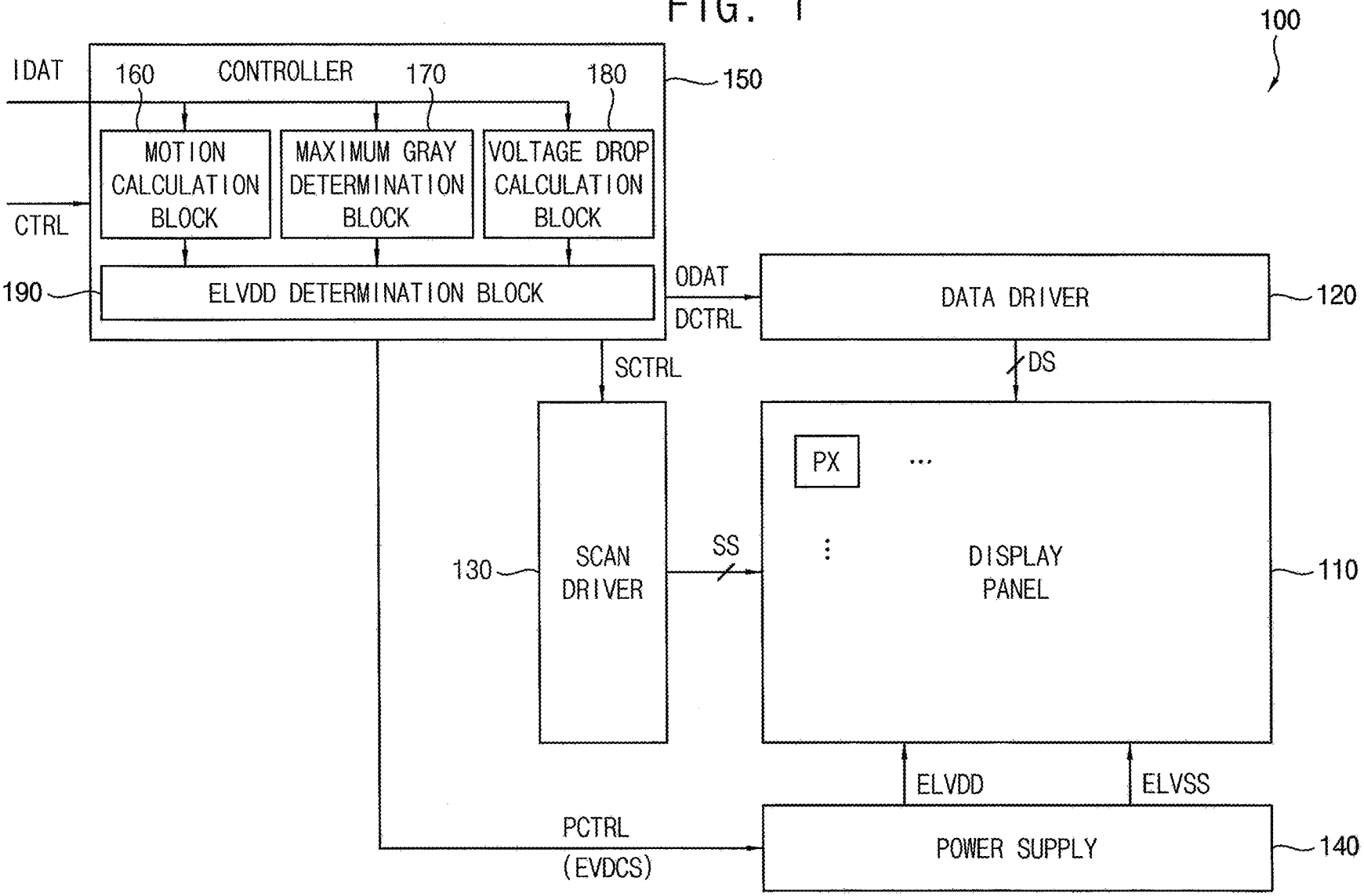
FIG. 1 is a block diagram illustrating a display device according to some example embodiments.
Figure 2:
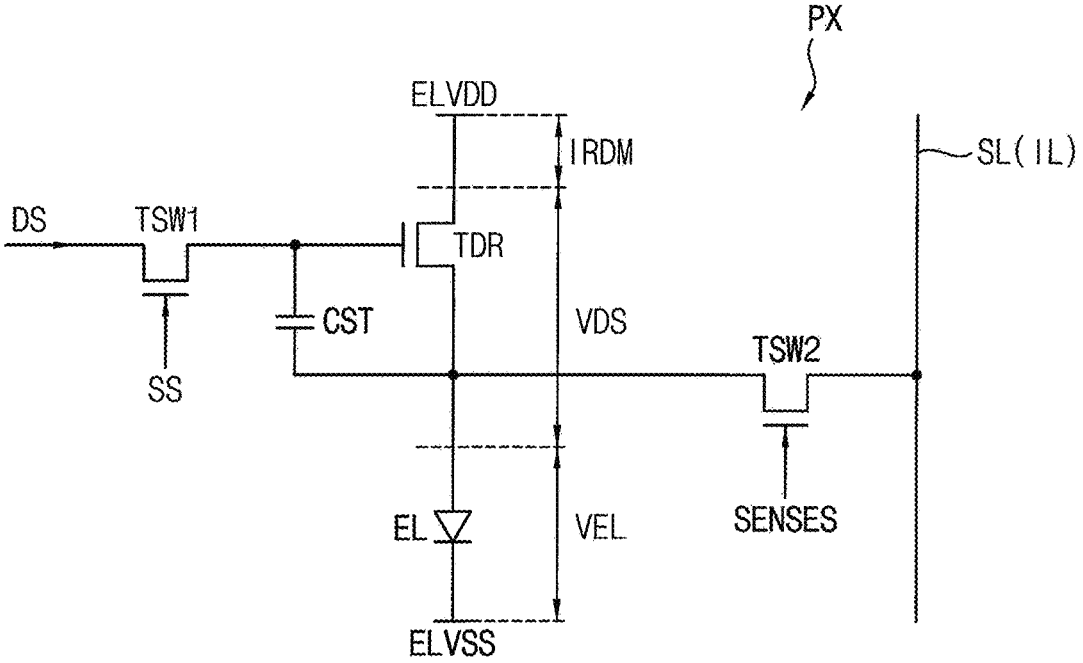
FIG. 2 is a circuit diagram illustrating an example of each pixel included in a display device according to some example embodiments.

FIG. 1 is a block diagram illustrating a display device according to some example embodiments, and FIG. 2 is a circuit diagram illustrating an example of each pixel included in a display device according to some example embodiments.

Referring to FIG. 1, a display device 100 according to some example embodiments may include a display panel 110 including a plurality of pixels PX, a power supply 140 providing a power supply voltage ELVDD and/or ELVSS to the display panel 110, and a controller 150 controlling the power supply 140. In some example embodiments, the display device 100 may further include a data driver 120 providing data signals DS to the display panel 110, and a scan driver 130 providing scan signals SS to the display panel 110.

The display panel 110 may include a plurality of data lines, a plurality of scan lines, and the plurality of pixels PX coupled to the plurality of data lines and the plurality of scan lines. According to some example embodiments, each pixel PX may include at least one capacitor, at least two transistors and an organic light emitting diode (OLED) configured to emit light with a set or predetermined color according to an image data signal, and the display panel 110 may be an OLED display panel.

For example, as illustrated in FIG. 2, each pixel PX may include a first switching transistor TSW1, a storage capacitor CST, a driving transistor TDR, the organic light emitting diode EL, and a second switching transistor TSW2.

The first switching transistor TSW1 may transfer the data signal DS to the storage capacitor CST in response to the scan signal SS. For example, the first switching transistor TSW1 may include a first terminal receiving the data signal DS, a second terminal coupled to a first electrode of the storage capacitor CST, and a gate receiving the scan signal SS output from the scan driver 130.

The storage capacitor CST may store the data signal DS transferred through the first switching transistor TSW1. For example, the storage capacitor CST may include the first electrode coupled to the second terminal of the first switching transistor TSW1 and a gate of the driving transistor TDR, and a second electrode coupled to a second terminal of the driving transistor TDR, an anode of the organic light emitting diode EL and a first terminal of the second switching transistor TSW2.

The driving transistor TDR may generate a driving current based on the data signal DS stored in the storage capacitor CST. For example, the driving transistor TDR may include a first terminal coupled to a line of a first power supply voltage ELVDD, the second terminal coupled to the second electrode of the storage capacitor CST, and the gate coupled to the first electrode of the storage capacitor CST.

The organic light emitting diode EL may emit light based on the driving current generated by the driving transistor TDR. For example, the organic light emitting diode EL may include the anode coupled to the second terminal of the driving transistor TDR, and a cathode coupled to a line of a second power supply voltage ELVSS.

The second switching transistor TSW2 may couple a node between the driving transistor TDR and the organic light emitting diode EL to a sensing line SL (or an initialization line IL) in response to a sense signal SENSES. For example, the second switching transistor TSW2 may include the first terminal coupled to the node, a second terminal coupled to the sensing line SL (or the initialization line IL), and a gate receiving the sense signal SENSES output from the scan driver 130.

Although FIG. 2 illustrates an example where each pixel PX has a 3T1C structure including three transistors TSW1, TDR and TSW2 and one capacitor CST, the pixel PX according to some example embodiments may have any other suitable pixel structure (including, for example, additional components or fewer components). In other example embodiments, the display panel 110 may be a liquid crystal display (LCD) panel, or any other suitable display panel.

The data driver 120 may provide the data signals DS to the plurality of pixels PX through the plurality of data lines based on output image data ODAT and a data control signal DCTRL received from the controller 150. In some example embodiments, the data control signal DCTRL may include, but not limited to, an output data enable signal, a horizontal start signal and a load signal. In some example embodiments, the data driver 120 and the controller 150 may be implemented with a single integrated circuit, and the single integrated circuit may be referred to as a timing controller embedded data driver (TED). In other example embodiments, the data driver 120 and the controller 150 may be implemented with separate integrated circuits.

The scan driver 130 may provide the scan signals SS to the plurality of pixels PX through the plurality of scan lines based on a scan control signal SCTRL received from the controller 150. In some example embodiments, the scan control signal SCTRL may include, but is not limited to, a scan start signal and a scan clock signal. In some example embodiments, the scan driver 130 may be integrated or formed in a peripheral portion of the display panel 110. In other example embodiments, the scan driver 130 may be implemented with one or more integrated circuits.

The power supply 140 may generate the first power supply voltage ELVDD and the second power supply voltage ELVSS based on a power control signal PCTRL, and may provide the first power supply voltage ELVDD and the second power supply voltage ELVSS to the plurality of pixels PX. In some example embodiments, the power control signal PCTRL may include a power supply voltage control signal EVDCS for controlling a voltage level of the first power supply voltage ELVDD (or the second power supply voltage ELVSS). In some example embodiments, the power supply 140 may be implemented with an integrated circuit, and the integrated circuit may be referred to as a power management integrated circuit (PMIC). In other example embodiments, the power supply 140 may be included in the controller 150 or the data driver 120.

The controller 150 (e.g., a timing controller (TCON)) may receive image data IDAT and a control signal CTRL from an external host (e.g., an application processor (AP), a graphic processing unit (GPU), a graphic card, etc.). In some example embodiments, the control signal CTRL may include, but not limited to, a vertical synchronization signal, a horizontal synchronization signal, an input data enable signal, a master clock signal, etc. The controller 150 may generate the output image data ODAT, the data control signal DCTRL, the scan control signal SCTRL and the power control signal PCTRL based on the image data IDAT and the control signal CTRL. The controller 150 may control an operation of the data driver 120 by providing the output image data ODAT and the data control signal DCTRL to the data driver 120, may control an operation of the scan driver 130 by providing the scan control signal SCTRL to the scan driver 130, and may control an operation of the power supply 140 by providing the power control signal PCTRL to the power supply 140.

As illustrated in FIG. 2, a voltage difference between the first power supply voltage ELVDD and the second power supply voltage ELVSS may be sufficiently large (e.g., sufficiently high or sufficiently great) by considering not only a drain-source voltage VDS of the driving transistor TDR and a voltage VEL applied to the organic light emitting diode EL, but also a voltage drop (e.g., an IR drop) margin IRDM of the first power supply voltage ELVDD. If the voltage difference between the first power supply voltage ELVDD and the second power supply voltage ELVSS is set to be excessively large, power consumption of the display device 100 may be excessively increased. Accordingly, to reduce the power consumption of the display device 100, a technique that adjusts or reduces the power supply voltage (e.g., the first power supply voltage ELVDD and/or the second power supply voltage ELVSS) may be utilized.

To reduce the power consumption, the controller 150 of the display device 100 according to some example embodiments may adjust a voltage level of the power supply voltage (e.g., the first power supply voltage ELVDD and/or the second power supply voltage ELVSS) by considering not only the maximum gray level of the image data IDAT and a voltage drop amount of the power supply voltage in the display panel 110, but also a motion amount of the image data IDAT. In a case where the motion amount is sufficiently large, or in a case where an image displayed by the display device 100 is dynamically changed, even if a display quality of the display device 100 is somewhat reduced, this display quality reduction may not be perceived by a viewer. Accordingly, in the case where the motion amount is sufficiently large, the display device 100 according to some example embodiments may decrease an absolute value of the power supply voltage (e.g., the first power supply voltage ELVDD and/or the second power supply voltage ELVSS), thereby reducing the power consumption of the display device 100 while substantially maintaining a perceived display quality. According to some example embodiments, to reduce the power consumption, the controller 150 may adjust, as the power supply voltage, the first power supply voltage ELVDD, the second power supply voltage ELVSS, or both of the first power supply voltage ELVDD and the second power supply voltage ELVSS. Hereinafter, an embodiment where the first power supply voltage ELVDD (or a high power supply voltage ELVDD) is adjusted to reduce the power consumption will be described in more detail below.

To adjust the power supply voltage ELVDD to reduce the power consumption, the controller 150 may include a motion calculation block 160, a maximum gray determination block 170, a voltage drop calculation block 180 and a power supply voltage determination block 190 (or an ELVDD determination block 190).

The motion calculation block 160 may calculate the motion amount of the image data IDAT based on the image data IDAT in a previous frame and the image data DIAT in a current frame, and may determine a motion gain based on the motion amount of the image data IDAT. In some example embodiments, the motion calculation block 160 may calculate, as the motion amount of the image data IDAT, a difference between the image data DIAT in the previous frame and the image data IDAT in the current frame, and may determine the motion gain such that the motion gain decreases as the motion amount of the image data IDAT increases. Further, in some example embodiments, the display panel 110 may be divided into a plurality of pixel blocks, and the motion calculation block 160 may calculate block motion amounts respectively for the plurality of pixel blocks, and may determine the single motion gain that is commonly used for the plurality of pixel blocks based on the block motion amounts. In other example embodiments, the motion calculation block 160 may calculate the block motion amounts respectively for the plurality of pixel blocks, and may determine block motion gains respectively for the plurality of pixel blocks.

The maximum gray determination block 170 may determine the maximum gray level of the image data IDAT in the current frame. In some example embodiments, the maximum gray determination block 170 may divide the image data IDAT for the display panel 110 into a plurality of block image data for the plurality of pixel blocks, and may determine a plurality of block maximum gray levels of the plurality of block image data.

The voltage drop calculation block 180 may calculate a voltage drop amount in the display panel 110 based on the image data IDAT in the current frame and resistor information for a wiring (or a line) of the power supply voltage ELVDD. In some example embodiments, the voltage drop calculation block 180 may convert the image data DAT for the display panel 110 into a current value, and may calculate the voltage drop amount by multiplying the current value and a resistance value represented by the resistor information. In some example embodiments, the resistor information for the wiring of the power supply voltage ELVDD may be generated based on layout design information of the display panel 110 for the wiring of the power supply voltage ELVDD. Further, in some example embodiments, the voltage drop calculation block 180 may determine block voltage drop amounts respectively for the plurality of pixel blocks.

The power supply voltage determination block 190 may determine an initial voltage level of the power supply voltage ELVDD based on the maximum gray level and the voltage drop amount, and may determine a final voltage level of the power supply voltage ELVDD by applying the motion gain to the initial voltage level. The power supply voltage determination block 190 may provide the power supply voltage control signal EVDCS representing the final voltage level to the power supply 140, and the power supply 140 may provide the power supply voltage ELVDD having the final voltage level to the display panel 110 in response to the power supply voltage control signal EVDCS. In some example embodiments, the voltage level of the power supply voltage ELVDD may be changed, for example, per frame. In some example embodiments, the power supply voltage determination block 190 may determine a first voltage level corresponding to the maximum gray level, may determine the initial voltage level by adding the voltage drop amount to the first voltage level, and may determine the final voltage level by multiplying the initial voltage level by the motion gain. In some example embodiments, the power supply voltage determination block 190 may determine first block voltage levels respectively corresponding to the block maximum gray levels, and may determine, as the initial voltage level, second block voltage levels respectively for the plurality of pixel blocks by adding the block voltage drop amounts to the first block voltage levels. Further, in some example embodiments, the power supply voltage determination block 190 may calculate third block voltage levels respectively for the plurality of pixel blocks by multiplying the second block voltage levels by the single motion gain, and may determine the final voltage level to be a maximum one of the third block voltage levels. In other example embodiments, the power supply voltage determination block 190 may calculate third block voltage levels respectively for the plurality of pixel blocks by multiplying the second block voltage levels by the block motion gains, respectively, and may determine the final voltage level to be a maximum one of the third block voltage levels. As described above, the voltage level of the power supply voltage ELVDD may be adjusted not only by the maximum gray level and the voltage drop amount, but also by the motion amount.

As described above, the display device 100 according to some example embodiments may calculate the motion amount based on the image data IDAT in the previous frame and the image data IDAT in the current frame, may determine the motion gain based on the motion amount, may determine the maximum gray level of the image data IDAT, may calculate the voltage drop amount based on the image data IDAT and the resistor information, may determine the initial voltage level of the power supply voltage ELVDD based on the maximum gray level and the voltage drop amount, and may determine the final voltage level of the power supply voltage ELVDD by applying the motion gain to the initial voltage level. Accordingly, the display device 100 according to some example embodiments may adjust the power supply voltage ELVDD by considering the motion amount. Thus, for example, in the case where the motion amount is sufficiently large, the display device 100 may decrease the power supply voltage ELVDD, thereby reducing the power consumption of the display device 100 while substantially maintaining the perceived display quality.

Figure 3:
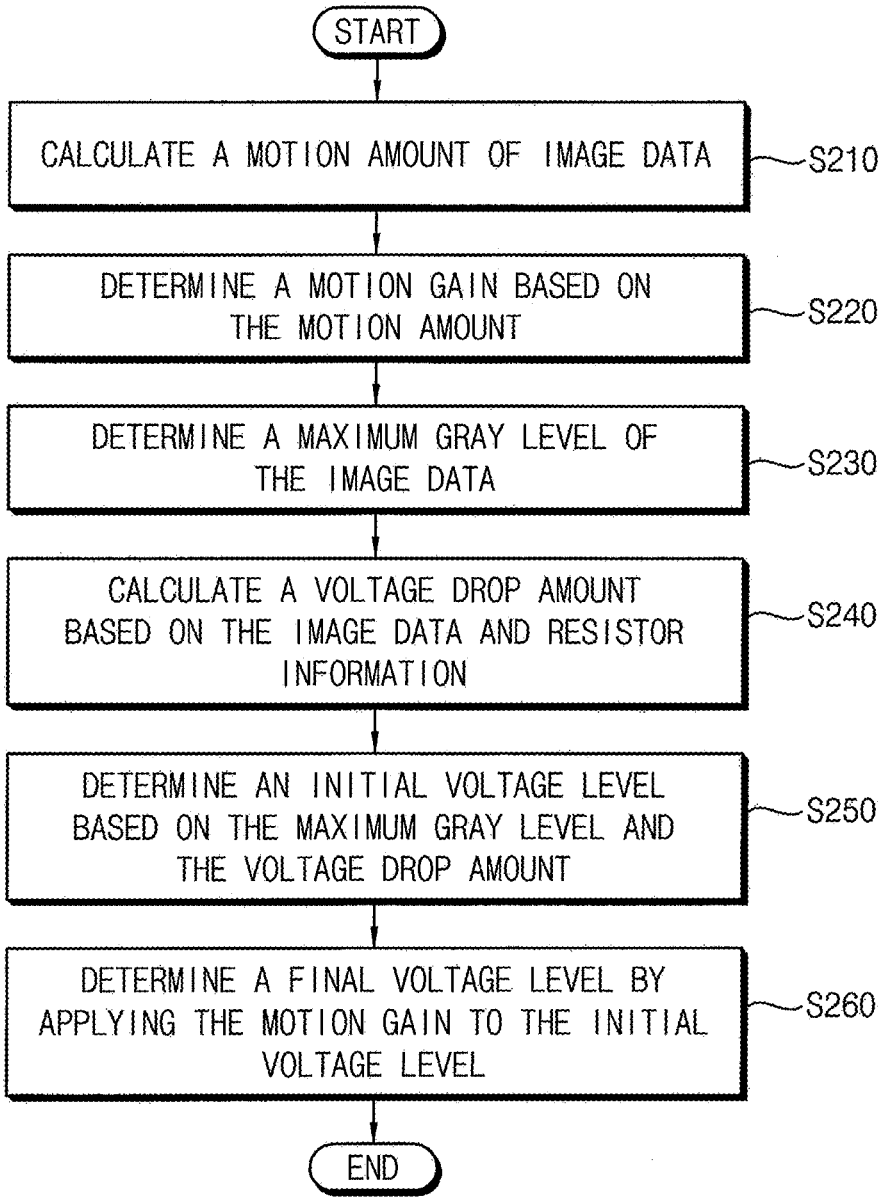
FIG. 3 is a flowchart illustrating a method of determining a power supply voltage provided to a display panel according to some example embodiments.

FIG. 3 is a flowchart illustrating a method of determining a power supply voltage provided to a display panel according to some example embodiments. Although FIG. 3 illustrates various operations in an example method of determining a power supply voltage, according to some example embodiments, embodiments are not limited thereto, and according to some example embodiments, the method may include additional operations or fewer operations, or the order of operations may vary (unless otherwise stated), without departing from the spirit and scope of embodiments according to the present disclosure.

Referring to FIGS. 1 and 3, in a method of determining a power supply voltage ELVDD provided to a display panel 110, a motion calculation block 160 may calculate a motion amount of image data IDAT based on the image data IDAT in a previous frame and the image data IDAT in a current frame (S210). In some example embodiments, the motion calculation block 160 may calculate, as the motion amount of the image data IDAT, a difference between the image data DIAT in the previous frame and the image data IDAT in the current frame.

The motion calculation block 160 may determine a motion gain based on the motion amount of the image data IDAT (S220). In some example embodiments, the motion calculation block 160 may determine the motion gain such that the motion gain decreases as the motion amount of the image data IDAT increases.

A maximum gray determination block 170 may determine the maximum gray level of the image data IDAT in the current frame (S230), and a voltage drop calculation block 180 may calculate a voltage drop amount in the display panel 110 based on the image data IDAT in the current frame and resistor information for a wiring (or a line) of the power supply voltage ELVDD in the display panel 110 (S240). In some example embodiments, the voltage drop calculation block 180 may convert the image data IDAT for the display panel 110 into a current value, and may calculate the voltage drop amount by multiplying the current value and a resistance value represented by the resistor information.

A power supply voltage determination block 190 may determine an initial voltage level of the power supply voltage ELVDD based on the maximum gray level and the voltage drop amount (S250). In some example embodiments, the power supply voltage determination block 190 may determine a first voltage level corresponding to the maximum gray level, and may determine the initial voltage level by adding the voltage drop amount to the first voltage level.

The power supply voltage determination block 190 may determine a final voltage level of the power supply voltage ELVDD by applying the motion gain to the initial voltage level (S260). In some example embodiments, the power supply voltage determination block 190 may determine the final voltage level by multiplying the initial voltage level by the motion gain. The power supply voltage determination block 190 may provide a power supply voltage control signal EVDCS representing the final voltage level to a power supply 140, and the power supply 140 may provide the power supply voltage ELVDD having the final voltage level to the display panel 110 in response to the power supply voltage control signal EVDCS. As described above, the voltage level of the power supply voltage ELVDD may be adjusted not only by the maximum gray level and the voltage drop amount, but also by the motion amount. Accordingly, the method of determining the power supply voltage ELVDD according to some example embodiments may adjust the power supply voltage ELVDD by considering the motion amount, and thus may reduce power consumption while substantially maintaining a perceived display quality.

Figure 4:
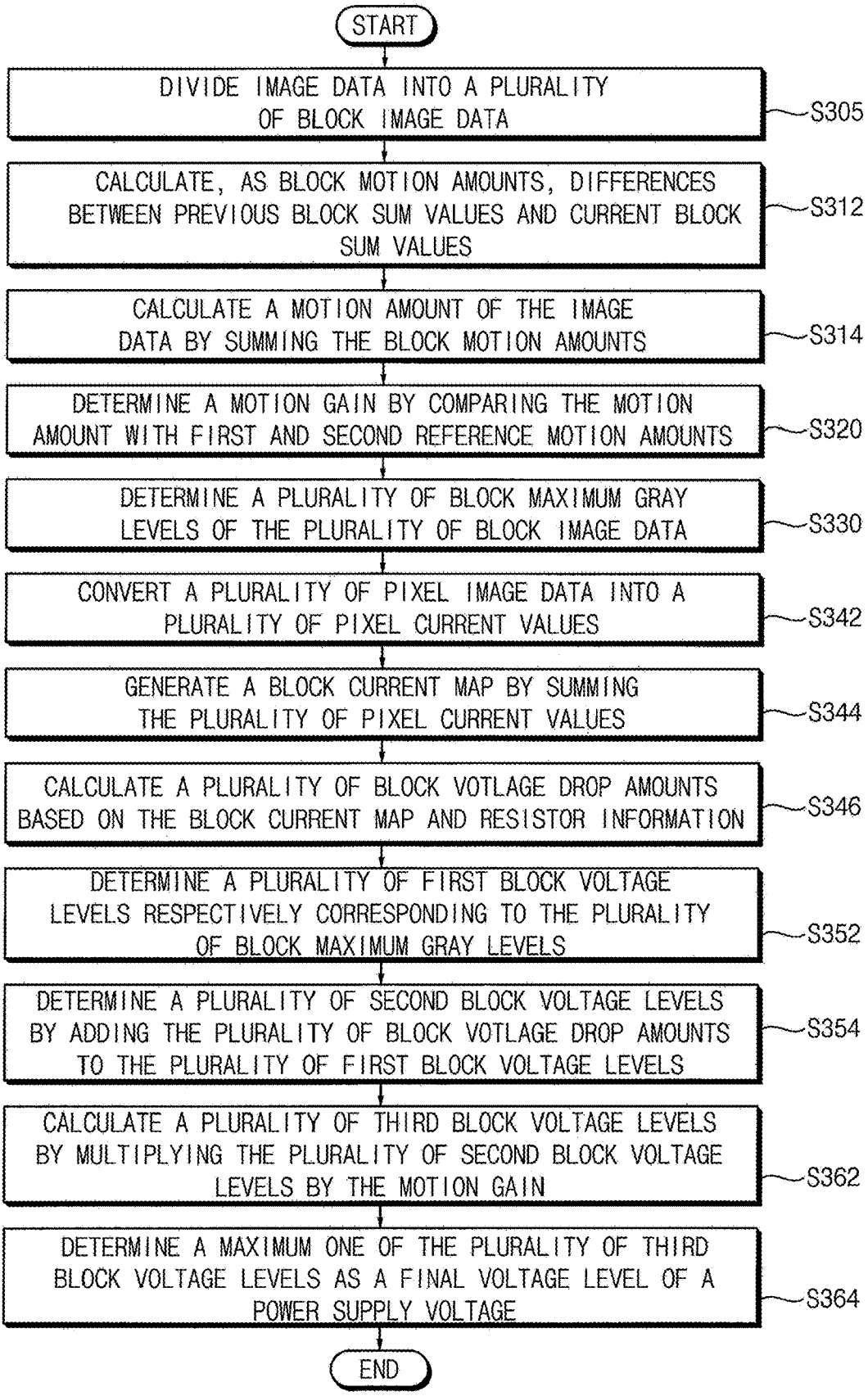
FIG. 4 is a flowchart illustrating a method of determining a power supply voltage provided to a display panel according to some example embodiments.
Figure 5:
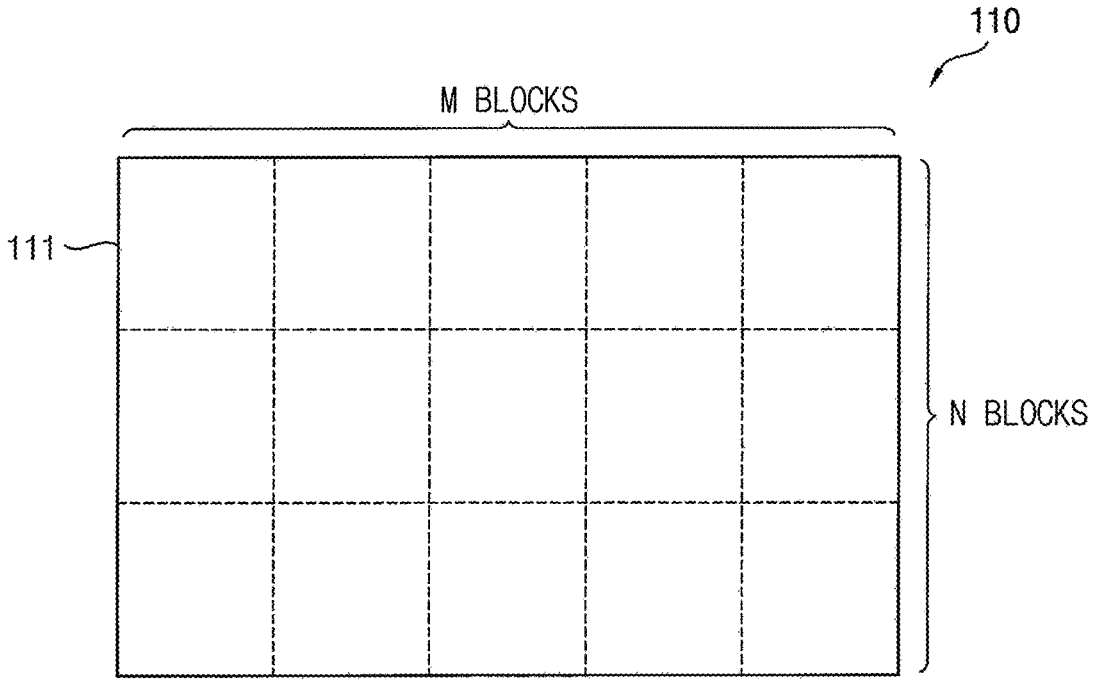
FIG. 5 is a diagram for describing an example where a display panel is divided into a plurality of pixel blocks.
Figure 6:
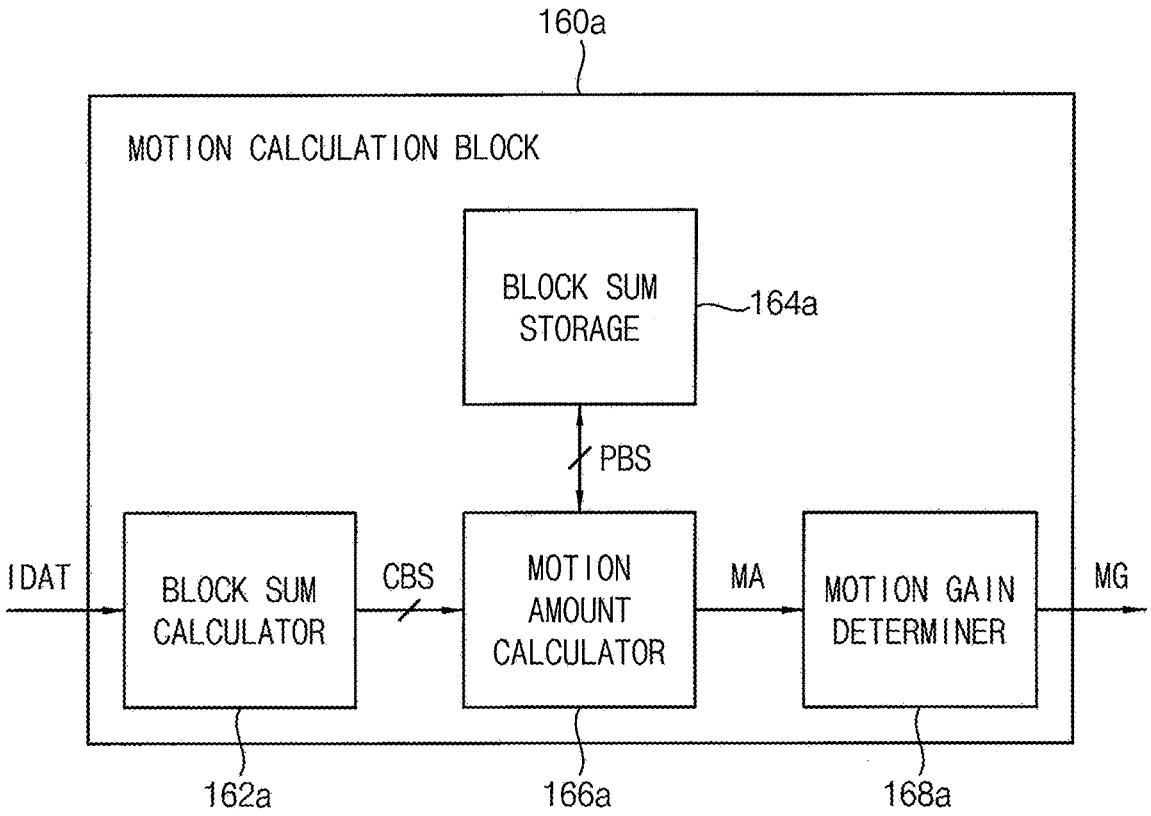
FIG. 6 is a block diagram illustrating a motion calculation block included in a display device according to some example embodiments.
Figure 7:
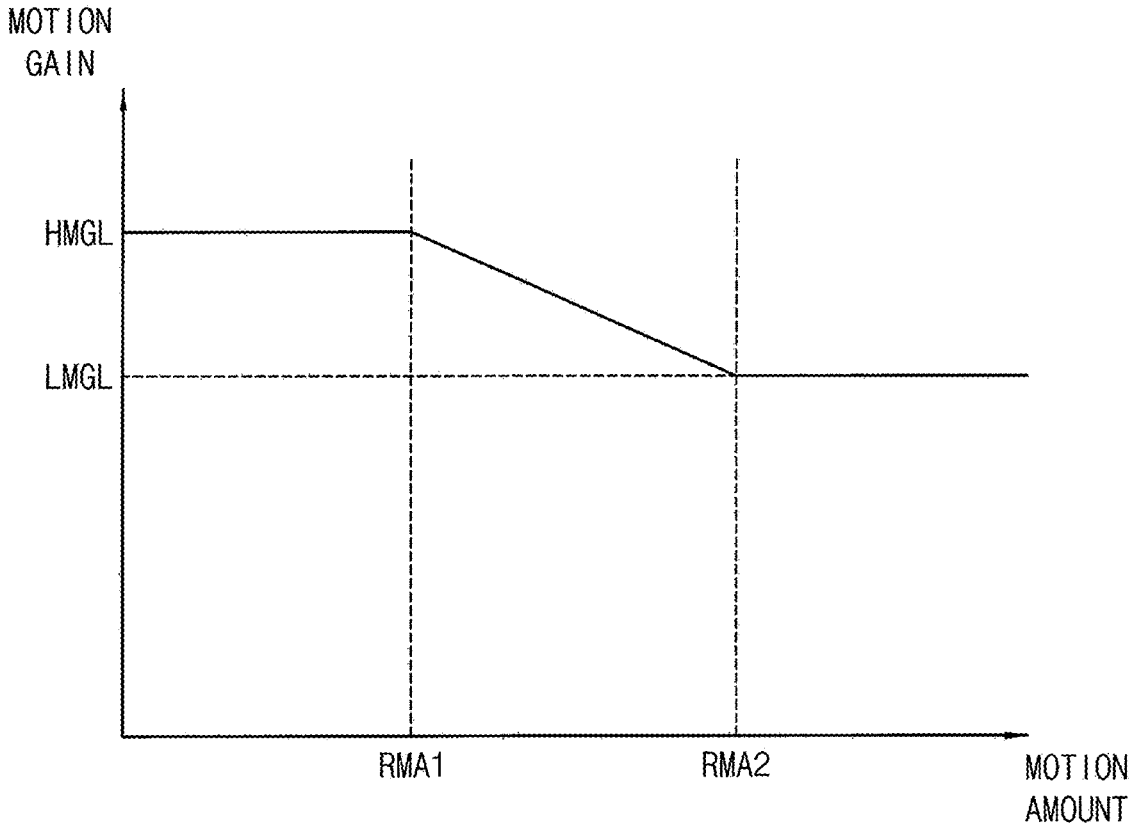
FIG. 7 is a graph illustrating an example of a motion gain according to a motion amount according to some example embodiments.
Figure 8:
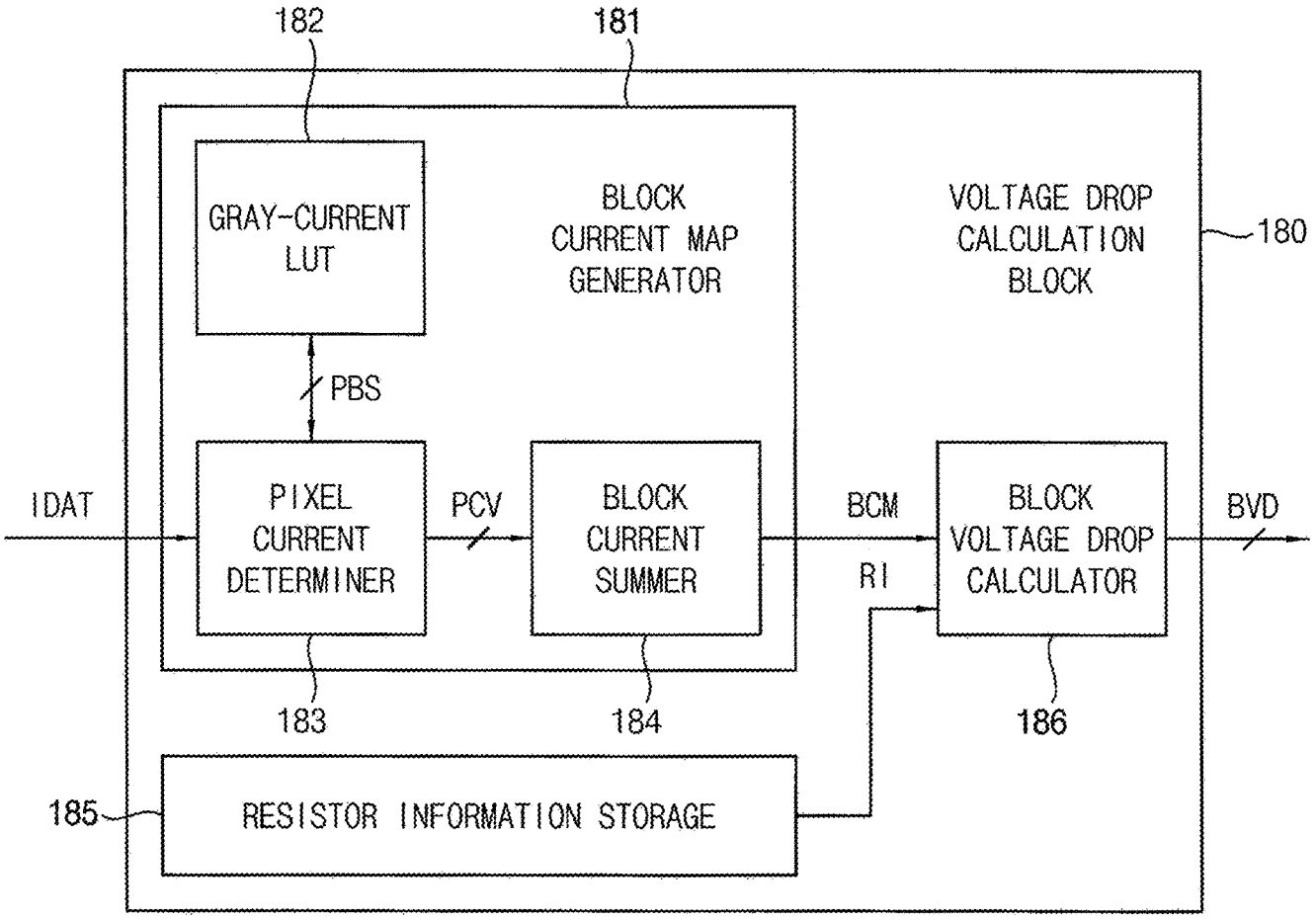
FIG. 8 is a block diagram illustrating a voltage drop calculation block included in a display device according to some example embodiments.
Figure 9:
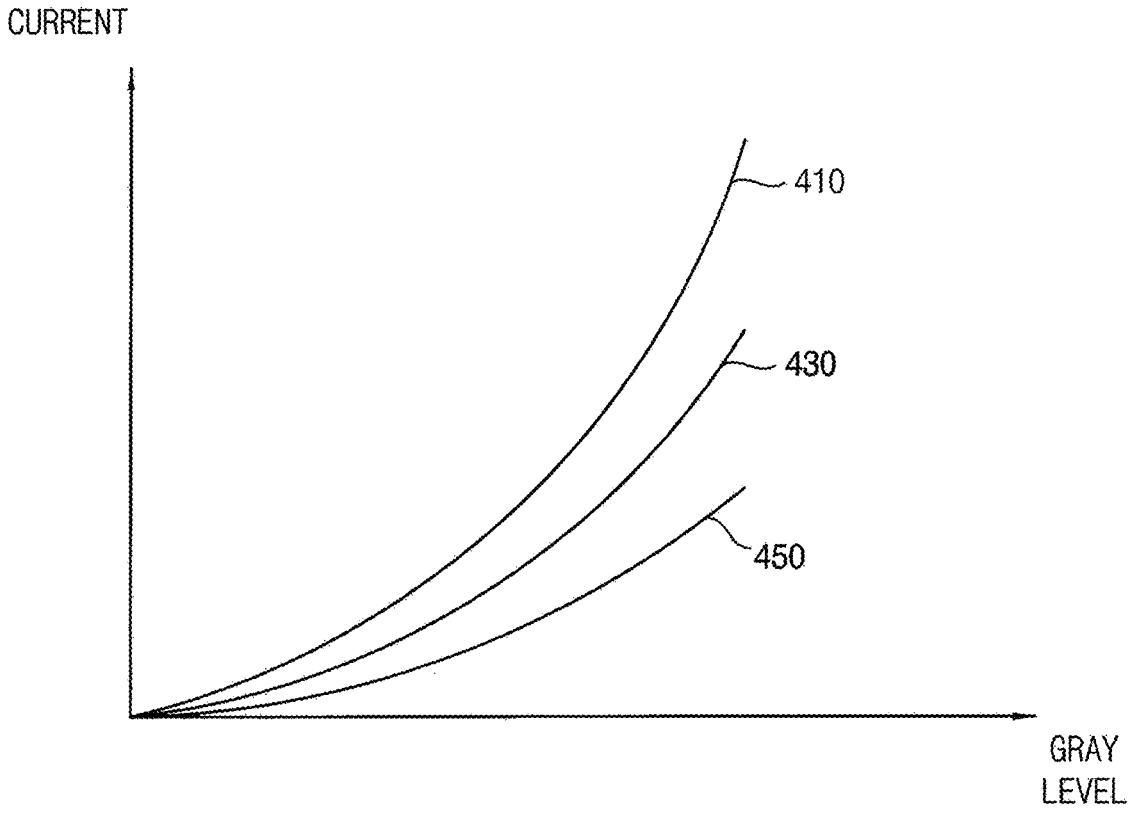
FIG. 9 is a graph for describing an example of a gray-current lookup table included in a voltage drop calculation block of FIG. 8.
Figure 10:
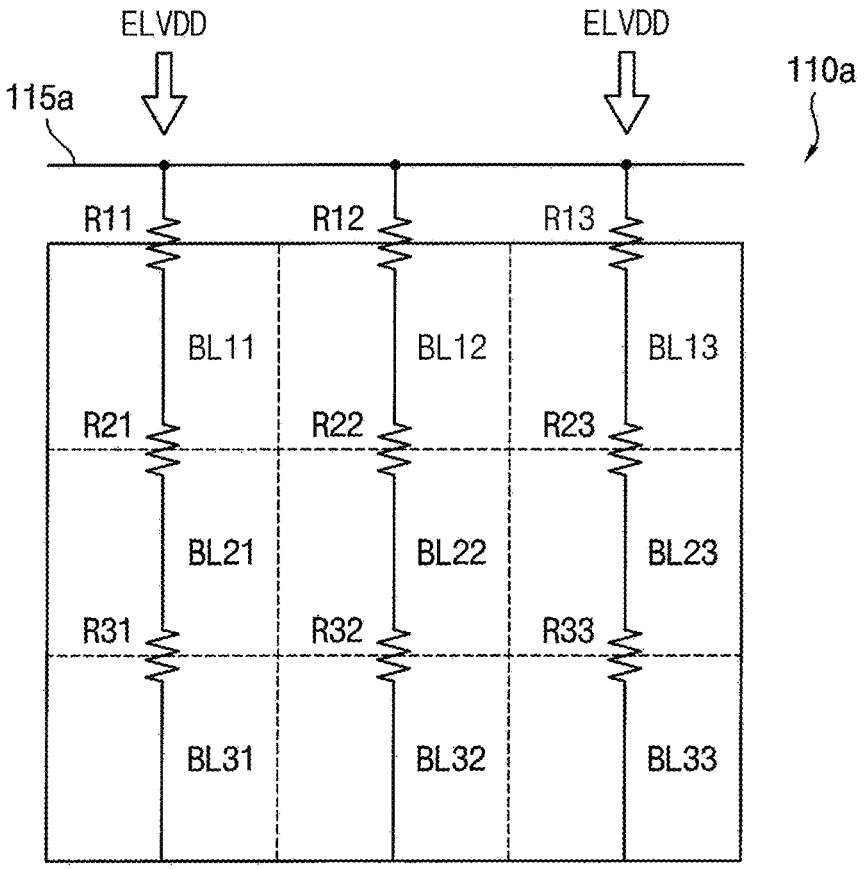
FIG. 10 is a diagram for describing an example of resistor information stored in a voltage drop calculation block of FIG. 8.
Figure 11:
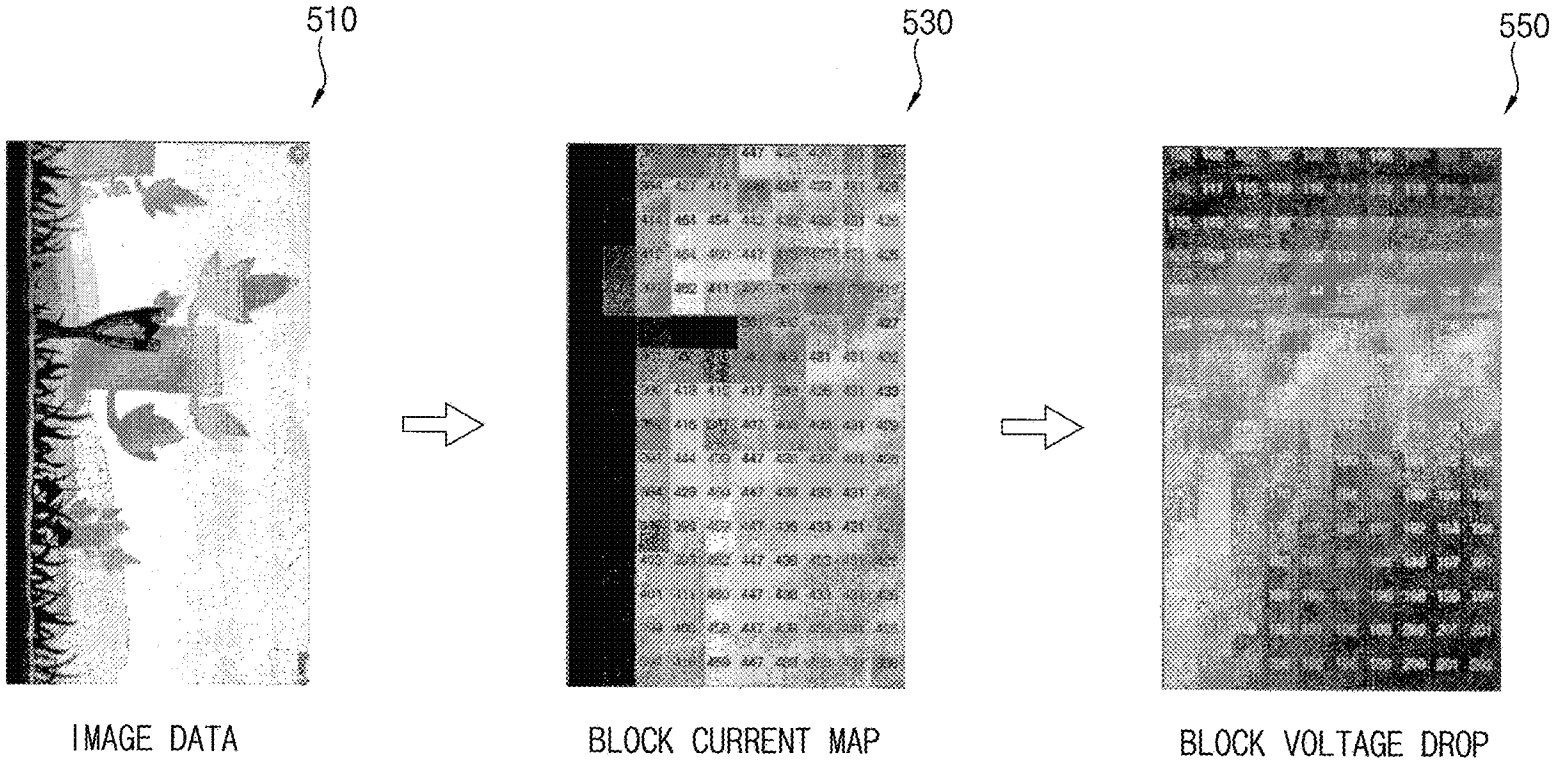
FIG. 11 is a diagram for describing an example of an operation of a voltage drop calculation block of FIG. 8.
Figures 12, 13:
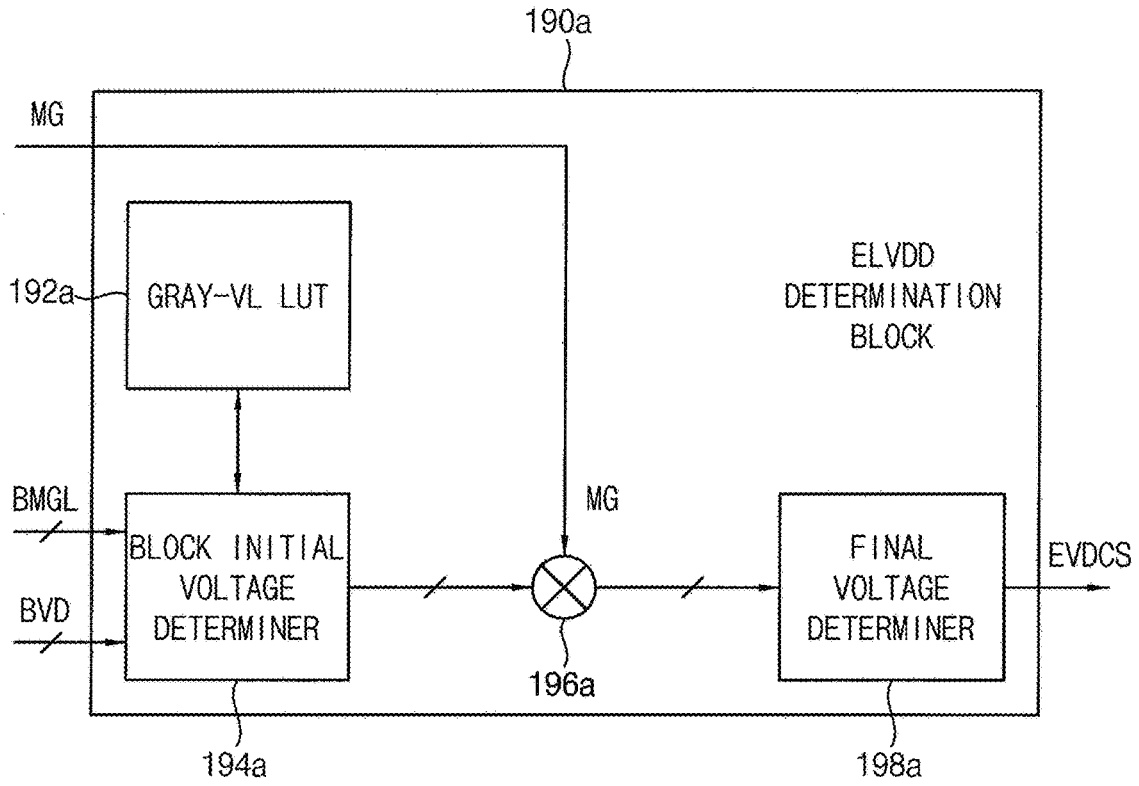
FIG. 12 is a block diagram illustrating a power supply voltage determination block included in a display device according to some example embodiments.
FIG. 13 is a graph for describing an example of a gray-current lookup table included in a power supply voltage determination block of FIG. 12.

FIG. 4 is a flowchart illustrating a method of determining a power supply voltage provided to a display panel according to some example embodiments, FIG. 5 is a diagram for describing an example where a display panel is divided into a plurality of pixel blocks, FIG. 6 is a block diagram illustrating a motion calculation block included in a display device according to some example embodiments, FIG. 7 is a graph illustrating an example of a motion gain according to a motion amount according to some example embodiments, FIG. 8 is a block diagram illustrating a voltage drop calculation block included in a display device according to some example embodiments, FIG. 9 is a graph for describing an example of a gray-current lookup table included in a voltage drop calculation block of FIG. 8, FIG. 10 is a diagram for describing an example of resistor information stored in a voltage drop calculation block of FIG. 8, FIG. 11 is a diagram for describing an example of an operation of a voltage drop calculation block of FIG. 8, FIG. 12 is a block diagram illustrating a power supply voltage determination block included in a display device according to some example embodiments, and FIG. 13 is a graph for describing an example of a gray-current lookup table included in a power supply voltage determination block of FIG. 12. Although FIG. 4 illustrates various operations in an example method, according to some example embodiments, embodiments are not limited thereto, and according to some example embodiments, the method may include additional operations or fewer operations, or the order of operations may vary (unless otherwise stated), without departing from the spirit and scope of embodiments according to the present disclosure.

Referring to FIGS. 1 and 4, in a method of determining a power supply voltage ELVDD provided to a display panel 110, the display panel 110 may be divided into a plurality of pixel blocks, and image data IDAT for the display panel 110 may be divided into a plurality of block image data for the plurality of pixel blocks (S305). For example, as illustrated in FIG. 5, the display panel 110 may be divided into the plurality of pixel blocks 111. For example, the display panel 110 may be divided to N block rows and M block columns, where N and M integers greater than 1, and thus the display panel 110 may be divided into N*M pixel blocks 111.

A motion calculation block 160 may store previous block sum values of the plurality of block image data in a previous frame, and may calculate current block sum values of the plurality of block image data in a current frame. Further, the current block sum values in the current frame may be stored as the previous block sum values for the next frame. The motion calculation block 160 may calculate, as block motion amounts of the plurality of block image data, differences between the previous block sum values and the current block sum values (S312). The motion calculation block 160 may calculate a motion amount of the image data IDAT by summing the block motion amounts of the plurality of block image data (S314). To perform these operations, in some example embodiments, as illustrated in FIG. 6, the motion calculation block 160*a* may include a block sum calculator 162*a*, a block sum storage 164*a*, a motion amount calculator 166*a* and a motion gain determiner 168*a*.

The block sum calculator 162*a* may calculate the current block sum values CBS of the plurality of block image data in the current frame by summing a plurality of pixel image data included in each block image data in the current frame. The previous block sum values PBS calculated in the previous frame may be stored in the block sum storage 164*a*. That is, the block sum storage 164*a* may store the previous block sum values PBS of the plurality of block image data in the previous frame. The motion amount calculator 166*a* may calculate, as the block motion amounts of the plurality of block image data, differences between the previous block sum values PBS and the current block sum values CBS, and may calculate the motion amount MA of the image data IDAT by summing the block motion amounts of the plurality of block image data. The motion gain determiner 168*a* may determine the motion gain MG based on the motion amount MA of the image data IDAT, and may provide the motion gain MG to a power supply voltage determination block 190.

The motion calculation block 160 may determine the motion gain by comparing the motion amount of the image data IDAT with a first reference motion amount and a second reference motion amount greater than the first reference motion amount (S320). For example, the motion gain determiner 168*a* of FIG. 6 may receive the motion amount MA from the motion amount calculator 166*a*, and may determine the motion gain MG by comparing the motion amount MA with the first and second reference motion amounts. In some example embodiments, as illustrated in FIG. 7, the motion gain determiner 168*a* may determine the motion gain MG as a high motion gain level HMGL when the motion amount MA is less than the first reference motion amount RMA1, and may determine the motion gain MG as a low motion gain level LMGL when the motion amount MA is greater than or equal to the second reference motion amount RMA2. Further, when the motion amount MA is greater than or equal to the first reference motion amount RMA1 and less than the second reference motion amount RMA2, the motion gain determiner 168*a* may determine the motion gain MG such that the motion gain MG gradually (e.g., linearly as illustrated in FIG. 7) decreases from the high motion gain level HMGL to the low motion gain level LMGL as the motion amount MA increases from the first reference motion amount RMA1 to the second reference motion amount RMA2. For example, the high motion gain level HMGL may be, but not limited to, about 1, and the low motion gain level LMGL may be, but not limited to, about 0.75.

A maximum gray determination block 170 may determine a plurality of block maximum gray levels of the plurality of block image data (S330). For example, the maximum gray determination block 170 may determine a maximum one of gray levels represented by the plurality of pixel image data included in each block image data as the block maximum gray level of the block image data.

A voltage drop calculation block 180 may convert the plurality of pixel image data included in the image data DAT into a plurality of pixel current values (S342). In some example embodiments, the voltage drop calculation block 180 may convert the plurality of pixel image data into the plurality of pixel current values by using a gray-current lookup table that stores current values respectively corresponding to a plurality of gray levels. Further, the voltage drop calculation block 180 may generate a block current map representing a plurality of block current values by calculating the plurality of block current values by summing the plurality of pixel current values with respect to each of the plurality of pixel blocks (S344). The voltage drop calculation block 180 may store resistor information representing a plurality of resistance values for a wiring of the power supply voltage ELVDD between the plurality of pixel blocks, and may calculate a plurality of block voltage drop amounts in the plurality of pixel blocks based on the plurality of block current values represented by the block current map and the plurality of resistance values represented by the resistor information (S346). To perform these operations, in some example embodiments, as illustrated in FIG. 8, the voltage drop calculation block 180 may include a block current map generator 181, a resistor information storage 185 and a block voltage drop calculator 186.

The block current map generator 181 may generate the block current map BCM representing the plurality of block current values for the plurality of pixel blocks based on the image data IDAT in the current frame. In some example embodiments, the block current map generator 181 may include a gray-current lookup table 182, a pixel current determiner 183 and a block current summer 184.

The gray-current lookup table 182 may store current values respectively corresponding to a plurality of gray levels (e.g., from a 0-gray level to a 255-gray level). In FIG. 9, examples of relationships between the plurality of gray levels and the current values stored in the gray-current lookup table 182 may be illustrated. In some example embodiments, as illustrated in FIG. 9, the current value may be nonlinearly increased as the gray level increases. For example, a gray-current value curve may correspond to, but not limited to, a gamma curve of the display panel 100. In some example embodiments, as illustrated in FIG. 9, the gray-current lookup table 182 may store the current values respectively corresponding to the plurality of gray levels with respect to each color of pixels PX. For example, in the gray-current lookup table 182, a gray-current value curve 410 for a green pixel PX, a gray-current value curve 430 for a red pixel PX and a gray-current value curve 450 for a blue pixel PX may be stored.

The pixel current determiner 183 may convert the plurality of pixel image data included in the image data IDAT into the plurality of pixel current values PCV by using the gray-current lookup table 182. The block current summer 184 may calculate the plurality of block current values by summing the plurality of pixel current values PCB with respect to each of the plurality of pixel blocks, and may generate the block current map BCM representing the plurality of block current values.

The resistor information storage 185 may store the resistor information RI representing a plurality of resistance values for the wiring of the power supply voltage ELVDD between the plurality of pixel blocks. For example, as illustrated in FIG. 10, in a case where the display panel 110*a* may be divided into first through ninth pixel blocks BL11, BL12, BL13, BL21, BL22, BL23, BL31, BL32 and BL33, and the display panel 110*a* may include the wiring 115*a* for supplying the power supply voltage ELVDD from the top of the display panel 110*a*, the resistor information storage 185 may store the resistor information RI representing resistance values of first through third resistors R11, R12 and R13 at the top of the first through third pixel blocks BL11, BL12 and BL13, resistance values of fourth through sixth resistors R21, R22 and R23 between the first through third pixel blocks BL11, BL12 and BL13 and the fourth through sixth pixel blocks BL21, BL22 and BL23, and resistance values of seventh through ninth resistors R31, R32 and R33 between the fourth through sixth pixel blocks BL21, BL22 and BL23 and the seventh through ninth pixel blocks BL31, BL32 and BL33. This resistor information RI may be determined according to layout design information of the display panel 110*a*. Further, although FIG. 10 illustrates an example where the wiring 115*a* of the power supply voltage ELVDD includes lines extending from the top of the display panel 110*a* to the bottom of the display panel 110*a*, the wiring 115*a* of the power supply voltage ELVDD may not be limited to the example of FIG. 10. For example, the display panel 110*a* may include the wiring 115*a* of the power supply voltage ELVDD having a mesh structure.

The block voltage drop calculator 186 may calculate a plurality of block voltage drop amounts BVD in the plurality of pixel blocks based on the plurality of block current values represented by the block current map BCM and the plurality of resistance values represented by the resistor information RI. In the example of FIG. 10, in a case where the block current value of the first block BL11 is I11, the block current value of the fourth block BL21 is I21, and the block current value of the seventh block BL31 is I31, the block voltage drop amount BVD of the first block BL11 may be calculated as "R11*(I11+I21+I31)", the block voltage drop amount BVD of the fourth block BL21 may be calculated as "R11*(I11+I21+I31)+R21*(I21+I31)", and the block voltage drop amount BVD of the seventh block BL31 may be calculated as "R11*(I11+I21+I31)+R21*(I21+I31)+R31*I31".

Thus, as illustrated in FIG. 11, the block current map generator 181 may generate the block current map BCM and 530 corresponding to the image data IDAT for an image 510, and the block voltage drop calculator 186 may calculate the plurality of block voltage drop amounts BVD in the plurality of pixel blocks as represented by 550 based on the block current map BCM and 530 received from the block current map generator 181 and the resistor information RI stored in the resistor information storage 185.

The power supply voltage determination block 190 may determine a plurality of first block voltage levels respectively corresponding to the plurality of block maximum gray levels (S352). In some example embodiments, the power supply voltage determination block 190 may determine the plurality of first block voltage levels respectively corresponding to the plurality of block maximum gray levels by using a gray-voltage level lookup table that stores voltage levels respectively corresponding to a plurality of gray levels. The power supply voltage determination block 190 may determine, as an initial voltage level of the power supply voltage ELVDD, a plurality of second block voltage levels by adding the plurality of block voltage drop amounts to the plurality of first block voltage levels, respectively (S354). The power supply voltage determination block 190 may calculate a plurality of third block voltage levels by multiplying the plurality of second block voltage levels by the motion gain (S362), and may determine a maximum one of the plurality of third block voltage levels as the final voltage level of the power supply voltage ELVDD (S364). To perform these operations, in some example embodiments, as illustrated in FIG. 12, the power supply voltage determination block 190*a* may include a gray-voltage level lookup table 192*a*, a block initial voltage determiner 194*a*, a multiplier 196*a* and a final voltage determiner 198*a*.

The gray-voltage level lookup table 192*a* may store voltage levels respectively corresponding to a plurality of gray levels. In some example embodiments, as illustrated in FIG. 13, the gray-voltage level lookup table 192*a* may store the voltage level ELVDD_VL of the first power supply voltage ELVDD corresponding to each gray level GRAY LEVEL. For example, the gray-voltage level lookup table 192*a* may store voltage levels EVDVL0, EVDVL1, . . . , EVDVL254 and EVDVL255 respectively corresponding to a 0-gray level 0G, a 1-gray level 1G, . . . , a 254-gray level 254G and a 255-gray level 255G.

The block initial voltage determiner 194*a* may receive the plurality of block maximum gray levels BMGL from the maximum gray determination block 170, may receive the plurality of block voltage drop amounts BVD from the voltage drop calculation block 180, may determine a plurality of first block voltage levels respectively corresponding to the plurality of block maximum gray levels BMGL by using the gray-voltage level lookup table 192*a*, and may determine a plurality of second block voltage levels by adding the plurality of block voltage drop amounts BVD to the plurality of first block voltage levels.

The multiplier 196*a* may receive the motion gain MG from the motion calculation block 160, and may calculate a plurality of third block voltage levels by multiplying the plurality of second block voltage levels by the motion gain MG.

The final voltage determiner 198*a* may determine a maximum one of the plurality of third block voltage levels, and may determine the determined maximum one as the final voltage level of the power supply voltage ELVDD. The final voltage determiner 198*a* may provide a power supply voltage control signal EVDCS representing the final voltage level to a power supply 140, and the power supply 140 may provide the power supply voltage ELVDD having the final voltage level to the display panel 110 in response to the power supply voltage control signal EVDCS.

As described above, in the method of determining the power supply voltage ELVDD according to some example embodiments, the plurality of block motion amounts may be calculated, the motion gain may be determined based on the plurality of block motion amounts, the plurality of first block voltage levels may be determined corresponding to the plurality of block maximum gray levels, the plurality of second block voltage levels may be determined by adding the plurality of block voltage drop amounts to the plurality of first block voltage levels, the plurality of third block voltage levels may be calculated by multiplying the plurality of second block voltage levels by the motion gain, and the maximum one of the plurality of third block voltage levels may be determined as the final voltage level of the power supply voltage ELVDD. The method of determining the power supply voltage ELVDD according to some example embodiments may adjust the power supply voltage ELVDD by considering the motion amount, and thus may reduce power consumption while substantially maintaining a perceived display quality.

Figure 14:
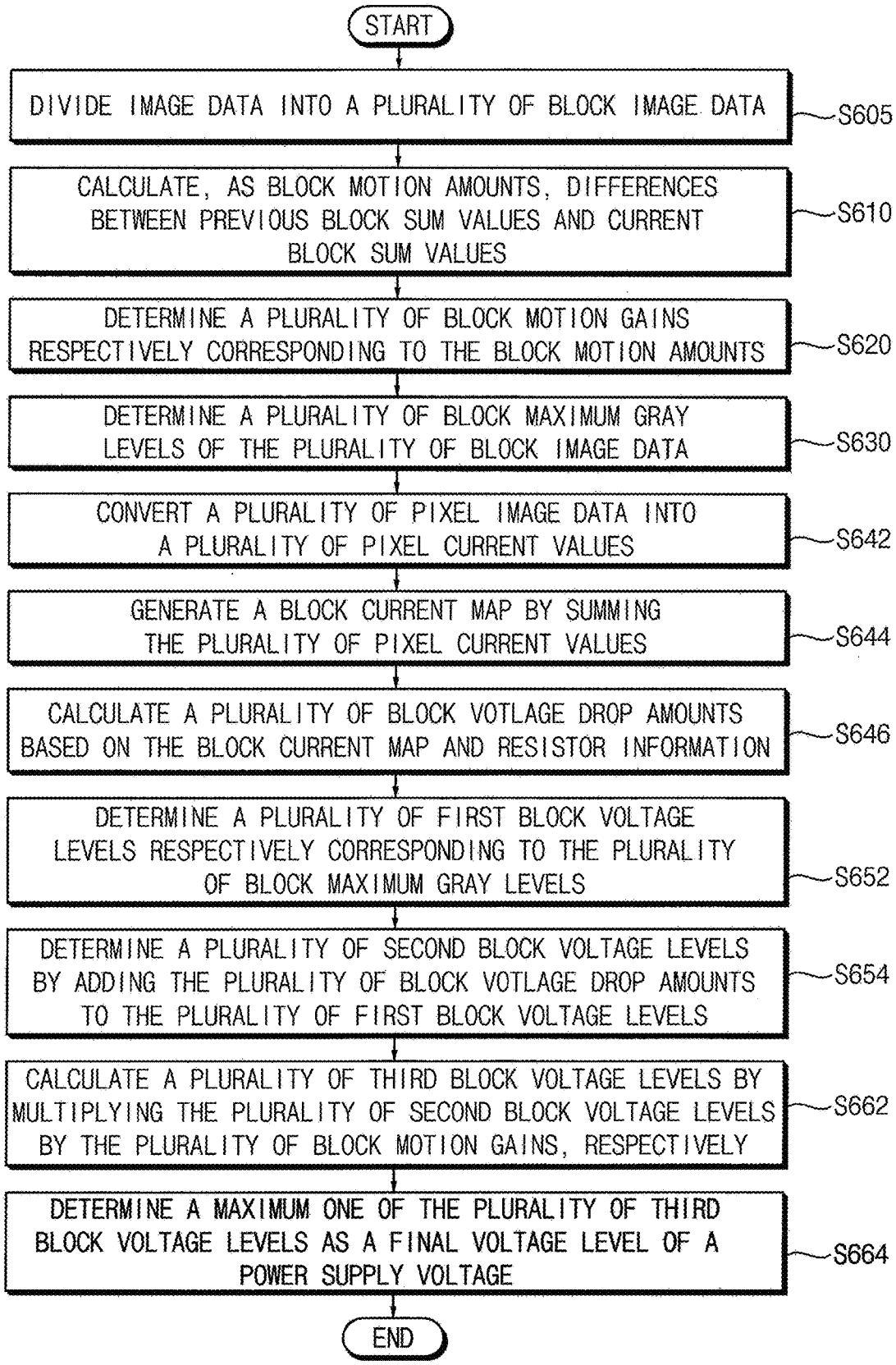
FIG. 14 is a flowchart illustrating a method of determining a power supply voltage provided to a display panel according to some example embodiments.
Figure 15:
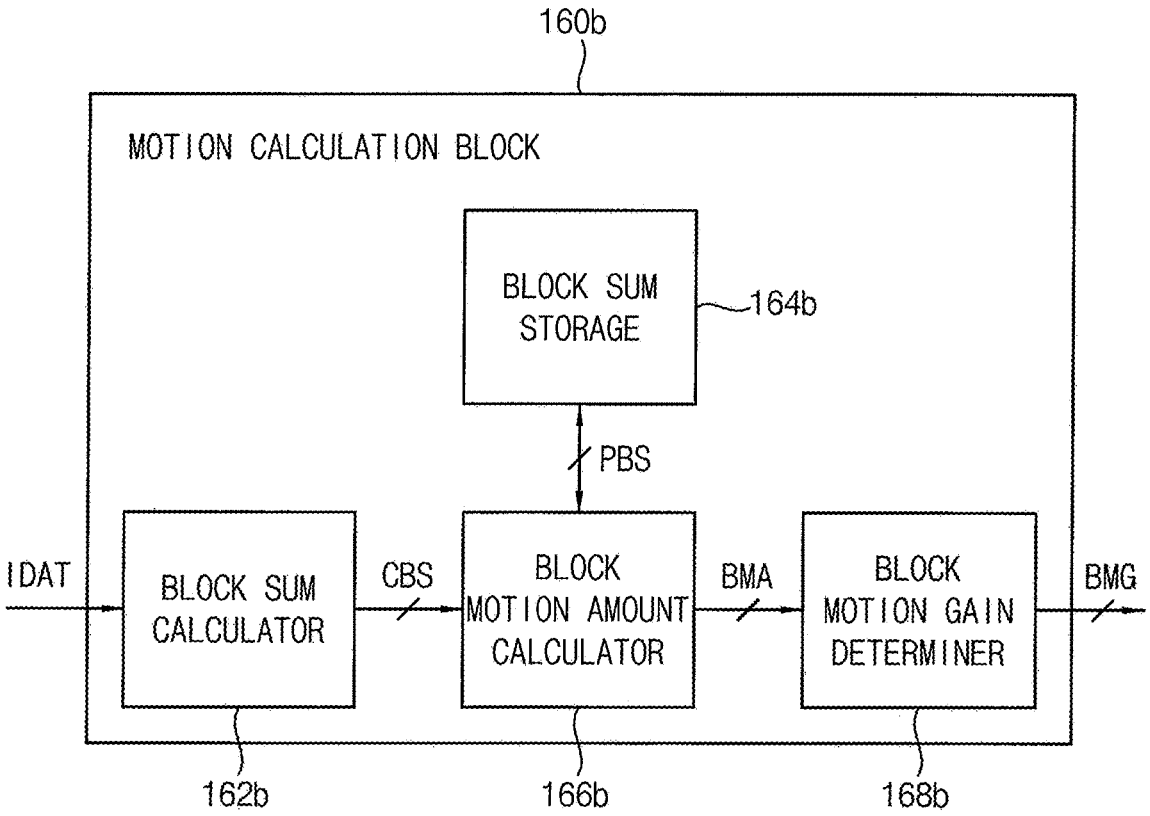
FIG. 15 is a block diagram illustrating a motion calculation block included in a display device according to some example embodiments.
Figure 16:
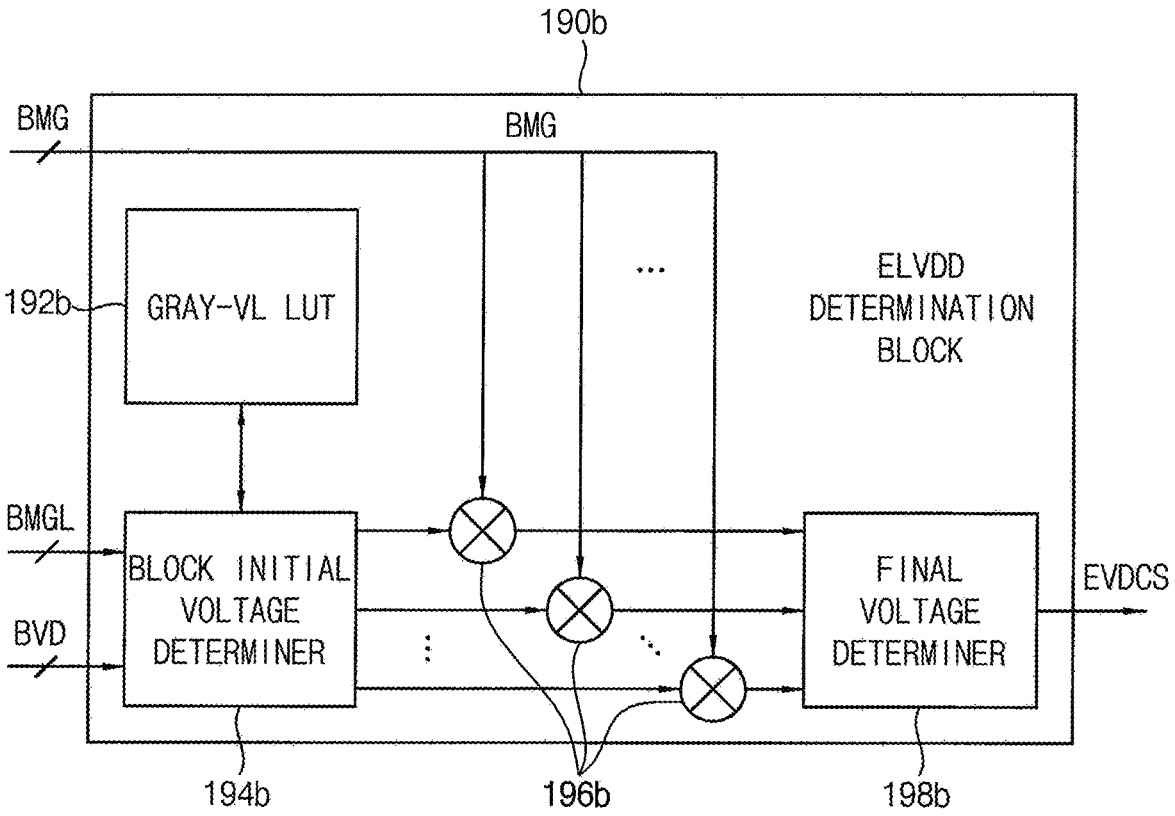
FIG. 16 is a block diagram illustrating a power supply voltage determination block included in a display device according to some example embodiments.

FIG. 14 is a flowchart illustrating a method of determining a power supply voltage provided to a display panel according to some example embodiments, FIG. 15 is a block diagram illustrating a motion calculation block included in a display device according to some example embodiments, and FIG. 16 is a block diagram illustrating a power supply voltage determination block included in a display device according to some example embodiments. Although FIG. 14 illustrates various operations in an example method, according to some example embodiments, embodiments are not limited thereto, and according to some example embodiments, the method may include additional operations or fewer operations, or the order of operations may vary (unless otherwise stated), without departing from the spirit and scope of embodiments according to the present disclosure.

Referring to FIGS. 1 and 14, in a method of determining a power supply voltage ELVDD provided to a display panel 110, the display panel 110 may be divided into a plurality of pixel blocks, and image data DAT for the display panel 110 may be divided into a plurality of block image data for the plurality of pixel blocks (S605).

A motion calculation block 160 may store previous block sum values of the plurality of block image data in a previous frame, may calculate current block sum values of the plurality of block image data in a current frame, and may calculate, as block motion amounts of the plurality of block image data, differences between the previous block sum values and the current block sum values (S610). The motion calculation block 160 may determine a plurality of block motion gains respectively corresponding to the block motion amounts of the plurality of block image data (S620). In some example embodiments, as illustrated in FIG. 15, the motion calculation block 160*b* may include a block sum calculator 162*b*, a block sum storage 164*b*, a block motion amount calculator 166*b* and a block motion gain determiner 168*b*. Compared with a motion calculation block 160*a* of FIG. 6, the motion calculation block 160*b* of FIG. 15 may include the block motion amount calculator 166*b* and the block motion gain determiner 168*b* instead of a motion amount calculator 166*a* and a motion gain determiner 168*a*.

The block sum storage 164*b* may store previous block sum values PBS of the plurality of block image data in the previous frame. The block sum calculator 162*b* may calculate current block sum values CBS of the plurality of block image data in the current frame. The block motion amount calculator 166*b* may calculate, as the block motion amounts BMA of the plurality of block image data, differences between the previous block sum values PBS and the current block sum values CBS. The block motion gain determiner 168*b* may determine the plurality of block motion gains BMG based on the block motion amounts BMA of the plurality of block image data.

In some example embodiments, the block motion gain determiner 168*b* may compare each of the block motion amounts BMA with a first reference motion amount and a second reference motion amount greater than the first reference motion amount. The block motion gain determiner 168*b* may determine each of the plurality of block motion gains BMG as a high motion gain level when a corresponding one of the block motion amounts BMA is less than the first reference motion amount, and may determine each of the plurality of block motion gains BMG as a low motion gain level when the corresponding one of the block motion amounts BMA is greater than or equal to the second reference motion amount. Further, when the corresponding one of the block motion amounts BMA is greater than or equal to the first reference motion amount and less than the second reference motion amount, the block motion gain determiner 168*b* may determine each of the plurality of block motion gains BMG such that each of the plurality of block motion gains BMG gradually decreases from the high motion gain level to the low motion gain level as the corresponding one of the block motion amounts BMA increases from the first reference motion amount to the second reference motion amount.

A maximum gray determination block 170 may determine a plurality of block maximum gray levels of the plurality of block image data (S630). A voltage drop calculation block 180 may convert the plurality of pixel image data included in the image data DAT into a plurality of pixel current values (S642), may generate a block current map representing a plurality of block current values by calculating the plurality of block current values by summing the plurality of pixel current values with respect to each of the plurality of pixel blocks (S644), and may calculate a plurality of block voltage drop amounts in the plurality of pixel blocks based on the plurality of block current values represented by the block current map and a plurality of resistance values represented by resistor information (S646).

A power supply voltage determination block 190 may determine a plurality of first block voltage levels respectively corresponding to the plurality of block maximum gray levels (S652), may determine a plurality of second block voltage levels by adding the plurality of block voltage drop amounts to the plurality of first block voltage levels, respectively (S654), may calculate a plurality of third block voltage levels by multiplying the plurality of second block voltage levels by the plurality of block motion gains, respectively (S662), and may determine a maximum one of the plurality of third block voltage levels as a final voltage level of the power supply voltage ELVDD (S664). To perform these operations, in some example embodiments, as illustrated in FIG. 16, the power supply voltage determination block 190*b* may include a gray-voltage level lookup table

192*b*, a block initial voltage determiner 194*b*, a plurality of multipliers 196*b* and a final voltage determiner 198*b*. Compared with a power supply voltage determination block 190*a* of FIG. 12, the power supply voltage determination block 190*b* of FIG. 16 may include the plurality of multipliers 196*b* instead of a multiplier 196*a*.

The gray-voltage level lookup table 192*b* may store voltage levels respectively corresponding to a plurality of gray levels. The block initial voltage determiner 194*b* may determine the plurality of first block voltage levels respectively corresponding to the plurality of block maximum gray levels by using the gray-voltage level lookup table 192*b*, and may determine the plurality of second block voltage levels by adding the plurality of block voltage drop amounts to the plurality of first block voltage levels. The plurality of multipliers 196*b* may calculate the plurality of third block voltage levels by multiplying the plurality of second block voltage levels by the plurality of block motion gains, respectively. The final voltage determiner 198*b* may determine the maximum one of the plurality of third block voltage levels as the final voltage level of the power supply voltage ELVDD. The final voltage determiner 198*b* may provide a power supply voltage control signal EVDCS representing the final voltage level to a power supply 140, and the power supply 140 may provide the power supply voltage ELVDD having the final voltage level to the display panel 110 in response to the power supply voltage control signal EVDCS.

As described above, in the method of determining the power supply voltage ELVDD according to some example embodiments, the plurality of block motion amounts may be calculated, the plurality of block motion gains may be determined based on the plurality of block motion amounts, the plurality of first block voltage levels may be determined corresponding to the plurality of block maximum gray levels, the plurality of second block voltage levels may be determined by adding the plurality of block voltage drop amounts to the plurality of first block voltage levels, the plurality of third block voltage levels may be calculated by multiplying the plurality of second block voltage levels by the plurality of block motion gains, respectively, and the maximum one of the plurality of third block voltage levels may be determined as the final voltage level of the power supply voltage ELVDD. The method of determining the power supply voltage ELVDD according to some example embodiments may adjust the power supply voltage ELVDD by considering the motion amount, or the plurality of block motion gains, and thus may reduce power consumption while substantially maintaining a perceived display quality.

Figure 17:
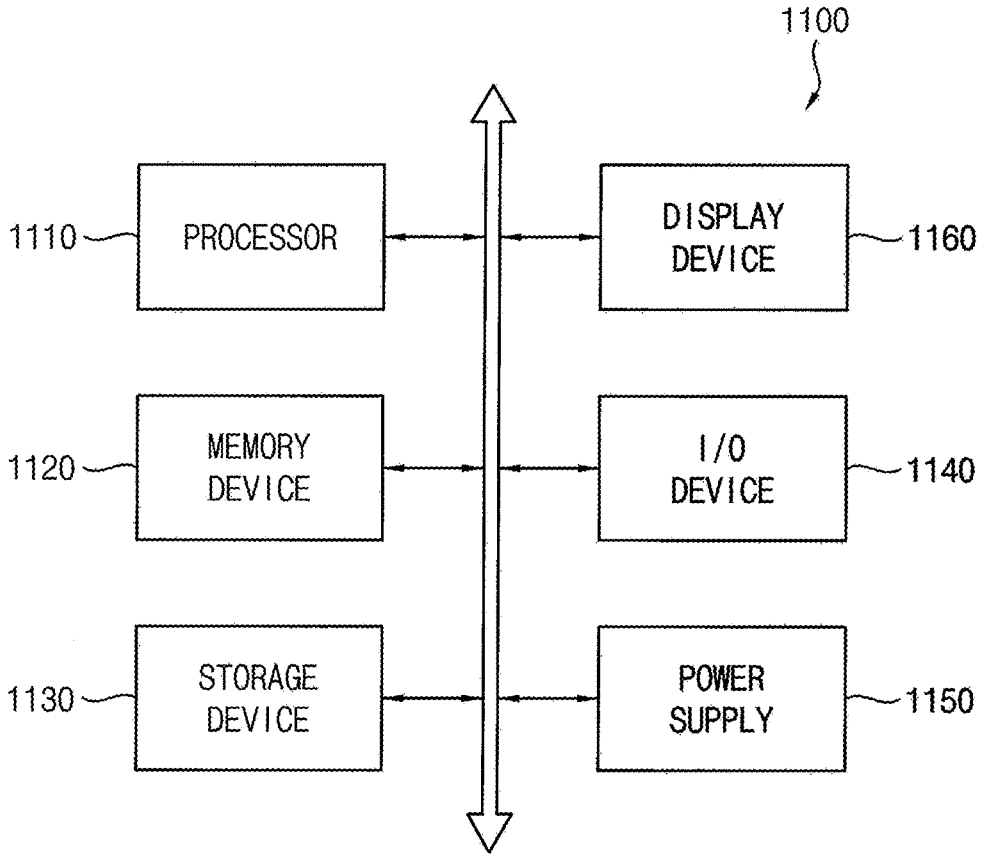
FIG. 17 is an electronic device including a display device according to some example embodiments.

FIG. 17 is an electronic device including a display device according to some example embodiments.

Referring to FIG. 17, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The display device 1160 may be coupled to other components through the buses or other communication links.

The display device 1160 may calculate a motion amount based on image data in a previous frame and the image data in a current frame, may determine a motion gain based on the motion amount, may determine a maximum gray level of the image data, may calculate a voltage drop amount based on the image data and resistor information, may determine an initial voltage level of a power supply voltage based on the maximum gray level and the voltage drop amount, and may determine a final voltage level of the power supply voltage by applying the motion gain to the initial voltage level. Accordingly, in the display device 1160 according to some example embodiments, because the power supply voltage may be adjusted by considering the motion amount, power consumption of the display device 1160 may be reduced while maintaining a perceived display quality.

The inventive concepts may be applied to any display device 1160, and any electronic device 1100 including the display device 1160. For example, the inventive concepts may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and characteristics of the present inventive concept. Accordingly, all such modifications are intended to be included within the scope of embodiments according to the present inventive concept as defined in the claims and their equivalents. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A display device comprising:

a display panel including a plurality of pixels;

a power supply configured to provide a power supply voltage to the display panel; and a controller configured to control the power supply, the controller including:

a motion calculation block configured to calculate a motion amount of image data based on the image data in a previous frame and the image data in a current frame, and to determine a motion gain based on the motion amount of the image data;

a maximum gray determination block configured to determine a maximum gray level of the image data in the current frame;

a voltage drop calculation block configured to calculate a voltage drop amount in the display panel based on the image data in the current frame and resistor information for a wiring of the power supply voltage; and a power supply voltage determination block configured to determine an initial voltage level of the power supply voltage based on the maximum gray level and the voltage drop amount, and to determine a final voltage level of the power supply voltage by applying the motion gain to the initial voltage level.

2. The display device of claim 1, wherein the motion calculation block is configured to calculate, as the motion amount of the image data, a difference between the image data in the previous frame and the image data in the current frame, and to determine the motion gain such that the motion gain decreases as the motion amount of the image data increases.

3. The display device of claim 1, wherein the image data for the display panel is divided into a plurality of block image data for a plurality of pixel blocks, and wherein the motion calculation block includes:

a block sum storage configured to store previous block sum values of the plurality of block image data in the previous frame;

a block sum calculator configured to calculate current block sum values of the plurality of block image data in the current frame;

a motion amount calculator configured to calculate, as block motion amounts of the plurality of block image data, differences between the previous block sum values and the current block sum values, and to calculate the motion amount of the image data by summing the block motion amounts of the plurality of block image data; and a motion gain determiner configured to determine the motion gain based on the motion amount of the image data.

4. The display device of claim 3, wherein the motion gain determiner is configured to:

compare the motion amount with a first reference motion amount and a second reference motion amount greater than the first reference motion amount;

determine the motion gain as a high motion gain level when the motion amount is less than the first reference motion amount;

determine the motion gain as a low motion gain level when the motion amount is greater than or equal to the second reference motion amount; and determine the motion gain such that the motion gain gradually decreases from the high motion gain level to the low motion gain level as the motion amount increases from the first reference motion amount to the second reference motion amount when the motion amount is greater than or equal to the first reference motion amount and less than the second reference motion amount.

5. The display device of claim 1, wherein the maximum gray determination block is configured to divide the image data for the display panel into a plurality of block image data for a plurality of pixel blocks, and to determine a plurality of block maximum gray levels of the plurality of block image data.

6. The display device of claim 1, wherein the voltage drop calculation block is configured to convert the image data for the display panel into a current value, and to calculate the voltage drop amount by multiplying the current value and a resistance value represented by the resistor information.

7. The display device of claim 1, wherein the display panel is divided into a plurality of pixel blocks, and wherein the voltage drop calculation block includes:

a block current map generator configured to generate a block current map representing a plurality of block current values for the plurality of pixel blocks based on the image data;

a resistor information storage configured to store the resistor information representing a plurality of resistance values for the wiring of the power supply voltage between the plurality of pixel blocks; and a block voltage drop calculator configured to calculate a plurality of block voltage drop amounts in the plurality of pixel blocks based on the plurality of block current values represented by the block current map and the plurality of resistance values represented by the resistor information.

8. The display device of claim 7, wherein the block current map generator includes:

a gray-current lookup table configured to store current values respectively corresponding to a plurality of gray levels;

a pixel current determiner configured to convert a plurality of pixel image data included in the image data into a plurality of pixel current values by using the gray-current lookup table; and a block current summer configured to calculate the plurality of block current values by summing the plurality of pixel current values with respect to each of the plurality of pixel blocks, and to generate the block current map representing the plurality of block current values.

9. The display device of claim 1, wherein the power supply voltage determination block is configured to determine a first voltage level corresponding to the maximum gray level, to determine the initial voltage level by adding the voltage drop amount to the first voltage level, and to determine the final voltage level by multiplying the initial voltage level by the motion gain.

10. The display device of claim 1, wherein the power supply voltage determination block is configured to receive a plurality of block maximum gray levels as the maximum gray level from the maximum gray determination block, and to receive a plurality of block voltage drop amounts as the voltage drop amount from the voltage drop calculation block, and wherein the power supply voltage determination block includes:

a gray-voltage level lookup table configured to store voltage levels respectively corresponding to a plurality of gray levels;

a block initial voltage determiner configured to determine a plurality of first block voltage levels respectively corresponding to the plurality of block maximum gray levels by using the gray-voltage level lookup table, and to determine a plurality of second block voltage levels by adding the plurality of block voltage drop amounts to the plurality of first block voltage levels;

a multiplier configured to calculate a plurality of third block voltage levels by multiplying the plurality of second block voltage levels by the motion gain; and a final voltage determiner configured to determine a maximum one of the plurality of third block voltage levels as the final voltage level of the power supply voltage.

11. The display device of claim 1, wherein the image data for the display panel is divided into a plurality of block image data for a plurality of pixel blocks, and wherein the motion calculation block includes:

a block sum storage configured to store previous block sum values of the plurality of block image data in the previous frame;

a block sum calculator configured to calculate current block sum values of the plurality of block image data in the current frame;

a block motion amount calculator configured to calculate, as block motion amounts of the plurality of block image data, differences between the previous block sum values and the current block sum values; and a block motion gain determiner configured to determine, as the motion gain, a plurality of block motion gains based on the block motion amounts of the plurality of block image data.

12. The display device of claim 11, wherein the block motion gain determiner is configured to:

compare each of the block motion amounts with a first reference motion amount and a second reference motion amount greater than the first reference motion amount;

determine each of the plurality of block motion gains as a high motion gain level when a corresponding one of the block motion amounts is less than the first reference motion amount;

determine each of the plurality of block motion gains as a low motion gain level when the corresponding one of the block motion amounts is greater than or equal to the second reference motion amount; and determine each of the plurality of block motion gains such that each of the plurality of block motion gains gradually decreases from the high motion gain level to the low motion gain level as the corresponding one of the block motion amounts increases from the first reference motion amount to the second reference motion amount when the corresponding one of the block motion amounts is greater than or equal to the first reference motion amount and less than the second reference motion amount.

13. The display device of claim 1, wherein the power supply voltage determination block is configured to receive a plurality of block motion gains as the motion gain from the motion calculation block, to receive a plurality of block maximum gray levels as the maximum gray level from the maximum gray determination block, and to receive a plurality of block voltage drop amounts as the voltage drop amount from the voltage drop calculation block, and wherein the power supply voltage determination block includes:

a gray-voltage level lookup table configured to store voltage levels respectively corresponding to a plurality of gray levels;

a block initial voltage determiner configured to determine a plurality of first block voltage levels respectively corresponding to the plurality of block maximum gray levels by using the gray-voltage level lookup table, and to determine a plurality of second block voltage levels by adding the plurality of block voltage drop amounts to the plurality of first block voltage levels;

a plurality of multipliers configured to calculate a plurality of third block voltage levels by multiplying the plurality of second block voltage levels by the plurality of block motion gains, respectively; and a final voltage determiner configured to determine a maximum one of the plurality of third block voltage levels as the final voltage level of the power supply voltage.

14. A method of determining a power supply voltage provided to a display panel, the method comprising:

calculating a motion amount of image data based on the image data in a previous frame and the image data in a current frame determining a motion gain based on the motion amount of the image data;

determining a maximum gray level of the image data in the current frame;

calculating a voltage drop amount in the display panel based on the image data in the current frame and resistor information for a wiring of the power supply voltage;

determining an initial voltage level of the power supply voltage based on the maximum gray level and the voltage drop amount; and determining a final voltage level of the power supply voltage by applying the motion gain to the initial voltage level.

15. The method of claim 14, further comprising:

dividing the image data for the display panel into a plurality of block image data for a plurality of pixel blocks, wherein calculating the motion amount of the image data includes:

storing previous block sum values of the plurality of block image data in the previous frame;

calculating current block sum values of the plurality of block image data in the current frame;

calculating, as block motion amounts of the plurality of block image data, differences between the previous block sum values and the current block sum values; and calculating the motion amount of the image data by summing the block motion amounts of the plurality of block image data.

16. The method of claim 14, wherein determining the motion gain based on the motion amount of the image data includes:

comparing the motion amount with a first reference motion amount and a second reference motion amount greater than the first reference motion amount;

determining the motion gain as a high motion gain level when the motion amount is less than the first reference motion amount;

determining the motion gain as a low motion gain level when the motion amount is greater than or equal to the second reference motion amount; and determining the motion gain such that the motion gain gradually decreases from the high motion gain level to the low motion gain level as the motion amount increases from the first reference motion amount to the second reference motion amount when the motion amount is greater than or equal to the first reference motion amount and less than the second reference motion amount.

17. The method of claim 14, wherein calculating the voltage drop amount in the display panel includes:

storing the resistor information representing a plurality of resistance values for the wiring of the power supply voltage between a plurality of pixel blocks;

converting a plurality of pixel image data included in the image data into a plurality of pixel current values by using a gray-current lookup table that stores current values respectively corresponding to a plurality of gray levels;

generating a block current map representing a plurality of block current values by calculating the plurality of block current values by summing the plurality of pixel current values with respect to each of the plurality of pixel blocks; and calculating a plurality of block voltage drop amounts in the plurality of pixel blocks based on the plurality of block current values represented by the block current map and the plurality of resistance values represented by the resistor information.

18. The method of claim 14, wherein the maximum gray level includes a plurality of block maximum gray levels, and the voltage drop amount includes a plurality of block voltage drop amounts, wherein determining the initial voltage level of the power supply voltage based on the maximum gray level and the voltage drop amount includes:

determining a plurality of first block voltage levels respectively corresponding to the plurality of block maximum gray levels by using a gray-voltage level lookup table that stores voltage levels respectively corresponding to a plurality of gray levels; and determining, as the initial voltage level, a plurality of second block voltage levels by adding the plurality of block voltage drop amounts to the plurality of first block voltage levels, and wherein determining the final voltage level of the power supply voltage by applying the motion gain to the initial voltage level includes:

calculating a plurality of third block voltage levels by multiplying the plurality of second block voltage levels by the motion gain; and determining a maximum one of the plurality of third block voltage levels as the final voltage level of the power supply voltage.

19. The method of claim 14, further comprising:

dividing the image data for the display panel into a plurality of block image data for a plurality of pixel blocks, wherein calculating the motion amount of the image data includes:

storing previous block sum values of the plurality of block image data in the previous frame;

calculating current block sum values of the plurality of block image data in the current frame; and calculating, as the motion amount, block motion amounts of the plurality of block image data by calculating differences between the previous block sum values and the current block sum values, and wherein determining the motion gain based on the motion amount of the image data includes:

determining, as the motion gain, a plurality of block motion gains based on the block motion amounts of the plurality of block image data.

20. The method of claim 19, wherein the maximum gray level includes a plurality of block maximum gray levels, and the voltage drop amount includes a plurality of block voltage drop amounts, wherein determining the initial voltage level of the power supply voltage based on the maximum gray level and the voltage drop amount includes:

determining a plurality of first block voltage levels respectively corresponding to the plurality of block maximum gray levels by using a gray-voltage level lookup table that stores voltage levels respectively corresponding to a plurality of gray levels; and determining, as the initial voltage level, a plurality of second block voltage levels by adding the plurality of block voltage drop amounts to the plurality of first block voltage levels, and wherein determining the final voltage level of the power supply voltage by applying the motion gain to the initial voltage level includes:

calculating a plurality of third block voltage levels by multiplying the plurality of second block voltage levels by the plurality of block motion gains, respectively; and determining a maximum one of the plurality of third block voltage levels as the final voltage level of the power supply voltage.

* * * * *